US011056060B2

(12) United States Patent
Kim et al.

(10) Patent No.: US 11,056,060 B2
(45) Date of Patent: Jul. 6, 2021

(54) DISPLAY DEVICE AND METHOD FOR IMPROVING IMAGE QUALITY WHEN DRIVEN AT LOW-FREQUENCIES

(71) Applicant: SAMSUNG DISPLAY CO., LTD., Yongin-si (KR)

(72) Inventors: Dong Hwi Kim, Yongin-si (KR); Na Young Kim, Yongin-si (KR); Yong Jae Kim, Yongin-si (KR); Chul Ho Kim, Yongin-si (KR); Jin Jeon, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/823,894

(22) Filed: Mar. 19, 2020

(65) Prior Publication Data

US 2020/0394961 A1 Dec. 17, 2020

(30) Foreign Application Priority Data

Jun. 12, 2019 (KR) ..... 10-2019-0069638

(51) Int. Cl.
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2310/08* (2013.01)

(58) Field of Classification Search
CPC . G09G 3/3266; G09G 3/3291; G09G 2310/08
See application file for complete search history.

(56) References Cited

U.S. PATENT DOCUMENTS

| | | | | |
|---|---|---|---|---|
| 7,414,599 | B2 | 8/2008 | Chung et al. | |
| 9,824,632 | B2 | 11/2017 | Chaji et al. | |
| 9,966,007 | B2 | 5/2018 | Cho et al. | |
| 2005/0007319 | A1* | 1/2005 | Shin | G09G 3/3241 345/76 |
| 2012/0162185 | A1* | 6/2012 | Park | G09G 3/3611 345/212 |

(Continued)

FOREIGN PATENT DOCUMENTS

| | | |
|---|---|---|
| KR | 10-0560780 | 3/2006 |
| KR | 10-2017-0003849 | 1/2017 |

(Continued)

*Primary Examiner* — Michael Pervan
(74) *Attorney, Agent, or Firm* — F. Chau & Associates, LLC

(57) ABSTRACT

A display device including: pixels coupled to first scan lines, second scan lines, emission control lines, and data lines; a first scan driver configured to supply a first scan signal to each of the first scan lines at a first frequency; a second scan driver configured to supply a second scan signal to each of the second scan lines at a second frequency corresponding to a driving frequency of the pixels; an emission driver configured to supply an emission control signal to each of the emission control lines at the first frequency; a data driver configured to supply a data signal to each of the data lines at the second frequency; and a timing controller configured to control the first scan driver, the second scan driver, the emission driver, and the data driver.

22 Claims, 21 Drawing Sheets

(56) References Cited

U.S. PATENT DOCUMENTS

| | | | | |
|---|---|---|---|---|
| 2015/0170607 | A1* | 6/2015 | Shin | G09G 3/3406 345/690 |
| 2015/0364083 | A1* | 12/2015 | Jeon | G09G 3/3266 345/76 |
| 2016/0379571 | A1* | 12/2016 | Kim | G09G 3/3233 345/215 |
| 2017/0092191 | A1* | 3/2017 | An | G09G 3/3233 |
| 2017/0124941 | A1* | 5/2017 | Na | G09G 3/3233 |
| 2017/0287390 | A1* | 10/2017 | Lee | G09G 3/3233 |
| 2017/0345371 | A1* | 11/2017 | Son | G09G 3/3266 |
| 2018/0293939 | A1 | 10/2018 | Kim et al. | |
| 2018/0342202 | A1 | 11/2018 | Sung et al. | |
| 2019/0096330 | A1 | 3/2019 | Kim et al. | |
| 2019/0172888 | A1 | 6/2019 | Choi et al. | |
| 2020/0105198 | A1* | 4/2020 | Park | G09G 3/3275 |
| 2021/0027696 | A1 | 1/2021 | Kim et al. | |

FOREIGN PATENT DOCUMENTS

| | | |
|---|---|---|
| KR | 10-2018-0078932 | 7/2018 |
| KR | 10-2018-0114981 | 10/2018 |
| KR | 10-2019-0034375 | 4/2019 |
| KR | 10-2019-0034729 | 4/2019 |
| KR | 10-2021-0013509 | 2/2021 |

* cited by examiner

DISPLAY DEVICE AND METHOD FOR IMPROVING IMAGE QUALITY WHEN DRIVEN AT LOW-FREQUENCIES

CROSS-REFERENCE TO RELATED APPLICATION

The present application claims priority under 35 U.S.C. § 119 to Korean patent application no. 10-2019-0069638 filed on Jun. 12, 2019, the disclosure of which is incorporated by reference herein in its entirety.

TECHNICAL FIELD

Exemplary embodiments of the present invention relate to a display device, and more particularly, to a display device which may be applied to various driving frequencies.

DESCRIPTION OF RELATED ART

A display device can function as an interface between a user and information.

The display device may include a plurality of pixels. Each of the pixels may include a plurality of transistors, a light emitting element electrically coupled to the transistors, and a capacitor. The transistors may be turned on in response to signals provided through lines such as scan lines and emission control lines. When the transistors are activated, a driving current may be generated to cause the light emitting element to emit light.

In an effort to reduce power consumption and enhance driving efficiency, a method of driving display devices with low frequencies may be employed. However, there may be a drop off in the display quality of the display devices that are operated at low frequencies.

SUMMARY

An exemplary embodiment of the present invention may provide a display device including: pixels coupled to first scan lines, second scan lines, emission control lines, and data lines; a first scan driver configured to supply a first scan signal to each of the first scan lines at a first frequency; a second scan driver configured to supply a second scan signal to each of the second scan lines at a second frequency corresponding to a driving frequency of the pixels; an emission driver configured to supply an emission control signal to each of the emission control lines at the first frequency; a data driver configured to supply a data signal to each of the data lines at the second frequency; and a timing controller configured to control operations of the first scan driver, the second scan driver, the emission driver, and the data driver.

In an exemplary embodiment of the present invention, the first frequency may be greater than the second frequency.

In an exemplary embodiment of the present invention, the second frequency is equal to the driving frequency and the second frequency and the driving frequency may correspond to a submultiple of the first frequency.

In an exemplary embodiment of the present invention, the first scan driver may supply the first scan signal to each of the first scan lines at the first frequency that is two times a maximum driving frequency of the display device.

In an exemplary embodiment of the present invention, the emission driver may supply the emission control signal to each of the emission control lines at the first frequency that is two times the maximum driving frequency of the display device.

In an exemplary embodiment of the present invention, when driven at the driving frequency, the second scan driver may supply the second scan signal during a first period of a frame period. When driven at the driving frequency, the second scan driver may not supply the second scan signal during a second period of the frame period.

In an exemplary embodiment of the present invention, when driven at the maximum driving frequency of the display device, a length of the first period may be equal to a length of the second period.

In an exemplary embodiment of the present invention, the first period may include a display scan period in which the first scan driver and the second scan driver supply the first and second scan signals so that the data signal is written to the pixels. The second period may include a self-scan period in which characteristics of a driving transistor included in each of the pixels is changed by the supply of the first scan signal from the first scan driver.

In an exemplary embodiment of the present invention, when the driving frequency is reduced, the number of self-scan periods included in the second period may be increased.

In an exemplary embodiment of the present invention, each of pixels disposed on an i-th (i is a natural number) horizontal line of the pixels may include: a light emitting element including a first electrode, and a second electrode coupled to a second power supply; a first transistor including a first electrode coupled to a first node electrically connected to a first power supply, and configured to control a driving current based on a voltage of a second node; a second transistor coupled between a data line of the data lines and the first node, and configured to be turned on by the first scan signal supplied to an i-th first scan line of the first scan lines; a third transistor coupled between the second node and a third node coupled to a second electrode of the first transistor, and configured to be turned on by the second scan signal supplied to an i-th second scan line of the second scan lines; a fourth transistor coupled between the second node and a first initialization power supply, and configured to be turned on by the second scan signal supplied to an i−1-th second scan line of the second scan lines; a fifth transistor coupled between the first power supply and the first node, and configured to be turned off by an emission control signal supplied to an i-th emission control line of the emission control lines; a sixth transistor coupled to the third node and the first electrode of the light emitting element, and configured to be turned off the emission control signal; and a storage capacitor coupled between the first power supply and the second node.

In an exemplary embodiment of the present invention, each of the pixels disposed on the i-th horizontal line may further include a seventh transistor coupled between the first electrode of the light emitting element and a second initialization power supply, and may be configured to be turned on by the first scan signal supplied to an i+1-th first scan line of the first scan lines. A voltage of the first initialization power supply may be different than a voltage of the second initialization power supply.

In an exemplary embodiment of the present invention, each of the pixels disposed on the i-th horizontal line may further include: a seventh transistor coupled between the first electrode of the light emitting element and the first initialization power supply, and configured to be turned on by the first scan signal supplied to an i+1-th first scan line of the first scan lines; and an eighth transistor coupled between the first node and the first initialization power supply, and configured to be turned on by the second scan signal supplied to the i−1-th second scan line.

In an exemplary embodiment of the present invention, each of the pixels disposed on the i-th horizontal line may further include: a seventh transistor coupled between the first electrode of the light emitting element and the first initialization power supply, and configured to be turned on by a first scan signal supplied to an i+1-th first scan line of the first scan lines; and an eighth transistor coupled between the third node and the first initialization power supply, and configured to be turned on by the second scan signal supplied to the i−1-th second scan line.

In an exemplary embodiment of the present invention, each of the first transistor, the second transistor, the fifth transistor, and the sixth transistor may be a P-type transistor. Each of the third transistor and the fourth transistor may be an N-type oxide semiconductor transistor.

In an exemplary embodiment of the present invention, each of the pixels disposed on the i-th horizontal line may further include a seventh transistor coupled between the first electrode of the light emitting element and a second initialization power supply, and may be configured to be turned on by the second scan signal supplied to the i-th second scan line. The seventh transistor may be an N-type oxide semiconductor transistor. A voltage of the first initialization power supply may be different than a voltage of the second initialization power supply.

In an exemplary embodiment of the present invention, each of the pixels disposed on the i-th horizontal line may further include a seventh transistor coupled between the first electrode of the light emitting element and the second initialization power supply, and may be configured to be turned on by the emission control signal supplied to the i-th emission control line. The seventh transistor may be an N-type oxide semiconductor transistor. The voltage of the first initialization power supply may be different than the voltage of the second initialization power supply.

In an exemplary embodiment of the present invention, each of pixels disposed on an i-th (i is a natural number) horizontal line of the pixels may include: a light emitting element including a first electrode, and a second electrode coupled to a second power supply; a first transistor including a first electrode coupled to a first node electrically connected to a first power supply, and configured to control a driving current based on a voltage of a second node; a second transistor coupled between a data line of the data lines and the first node, and configured to be turned on by the first scan signal supplied to an i-th first scan line of the first scan lines; a third transistor coupled between the second node and a third node coupled to a second electrode of the first transistor, and configured to be turned on by the second scan signal supplied to an i-th second scan line of the second scan lines; a fourth transistor coupled between the second node and a first initialization power supply, and configured to be turned on by a third scan signal supplied to an i-th third scan line; and a fifth transistor coupled between the first power supply and the first node, and configured to be turned off by the emission control signal supplied to an i-th emission control line of the emission control lines.

In an exemplary embodiment of the present invention, the display device may further include a third scan driver configured to supply a third scan signal to each of third scan lines coupled to the pixels at the second frequency. Widths of the second and the third scan signals may be greater than a width of the first scan signal.

In an exemplary embodiment of the present invention, when driven at the driving frequency, the second and the third scan drivers may respectively supply the second and third scan signals during a first period of a frame period. When driven at the driving frequency, the second and the third scan drivers may not supply the second and third scan signals during a second period of the frame period.

In an exemplary embodiment of the present invention, during the first period, the second scan signal supplied to the i-th second scan line may not overlap with the third scan signal supplied to the i-th third scan line.

In an exemplary embodiment of the present invention, during the first period, the third scan signal supplied to the i-th third scan signal may overlap with a first portion of the second scan signal supplied to the i-th second scan line, and the first scan signal supplied to the i-th first scan line may overlap with a second portion of the second scan signal supplied to the i-th second scan line.

An exemplary embodiment of the present invention may provide a display device including: pixels coupled to first scan lines, second scan lines, emission control lines, and data lines; a first scan driver configured to supply a first scan signal to each of the first scan lines at a first frequency; a second scan driver configured to supply a second scan signal to each of the second scan lines at a second frequency, wherein the first frequency is greater than the second frequency; an emission driver configured to supply an emission control signal to each of the emission control lines at the first frequency; a data driver configured to supply a data signal to each of the data lines at the second frequency; and a timing controller configured to control the second scan driver to supply the second scan signal during a first period of a frame period and not supply the second scan signal during a second period of the frame period.

DETAILED DESCRIPTION OF THE EMBODIMENTS

Figure 1:
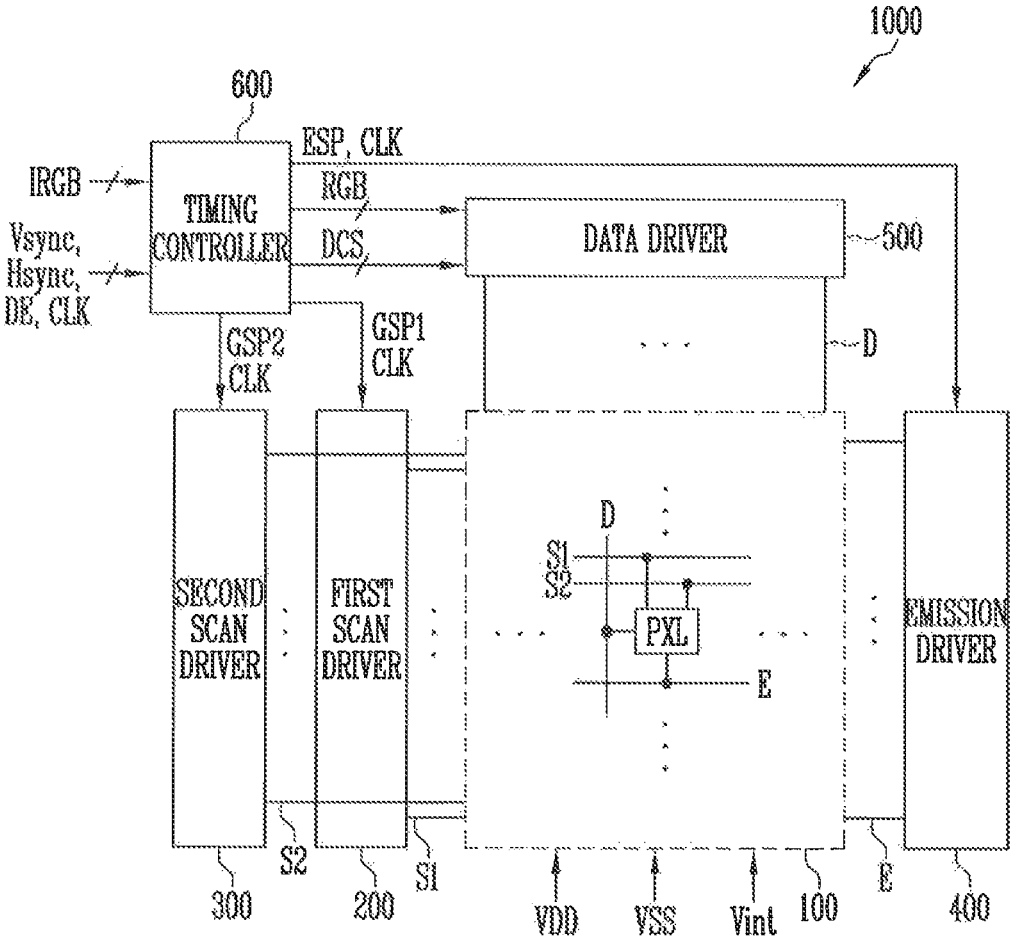
FIG. 1 is a block diagram illustrating a display device in accordance with exemplary embodiments of the present invention.

Exemplary embodiments of the present invention will hereinafter be described in detail with reference to the accompanying drawings. The same reference numerals used throughout the drawings may designate the same components, and thus, repetitive descriptions of the same components may be omitted.

FIG. 1 is a block diagram illustrating a display device 1000 in accordance with exemplary embodiments of the present invention.

Referring to FIG. 1, the display device 1000 may include a pixel unit 100, a first scan driver 200, a second scan driver 300, an emission driver 400, a data driver 500, and a timing controller 600.

The display device 1000 may display images using various driving frequencies depending on driving conditions. In an exemplary embodiment of the present invention, the display device 1000 may adjust, depending on driving conditions, an output frequency of the second scan driver 300 and an output frequency of the data driver 500 corresponding to the output frequencies of the first and second scan drivers 200 and 300. For example, the display device 1000 may display images in response to various driving frequencies ranging from 1 Hz to 120 Hz.

The timing controller 600 may be supplied with input image data IRGB and timing signals Vsync, Hsync, DE, and CLK from a host system such as an application processor (AP) through an interface.

The timing controller 600 may generate a data driving control signal DCS, based on the input image data IRGB and the timing signals such as a vertical synchronous signal Vsync, a horizontal synchronous signal Hsync, a data enable signal DE, and a clock signal CLK. The data driving control signal DCS may be supplied to the data driver 500. The timing controller 600 may rearrange the input image data IRGB and supply the rearranged input image data IRGB to the data driver 500.

The timing controller 600 may supply gate start pulses GSP1 and GSP2 and clock signals CLK to the first scan driver 200 and the second scan driver 300 based on the timing signals.

The timing controller 600 may supply an emission start pulse ESP and clock signals CLK to the emission driver 400, based on the timing signals. The emission start pulse ESP may control a first timing of an emission control signal. The clock signals CLK provided to the emission driver 400 may be used to shift the emission start pulse.

A first gate start pulse GSP1 may control a first timing of a scan signal to be supplied from the first scan driver 200. The clock signals CLK provided to the first scan driver 200 may be used to shift the first gate start pulse GSP1.

A second gate start pulse GSP2 may control a first timing of a scan signal to be supplied from the second scan driver 300. The clock signals CLK provided to the second scan driver 300 may be used to shift the second gate start pulse GSP2.

The data driver 500 may supply data signals to data lines D in response to the data driving control signal DCS. The data signals supplied to the data lines D may be supplied to pixels PXL selected by scan signals.

The data driver 500 may supply data signals to the data lines D during a frame period in response to a driving frequency. For example, the data driver 500 may supply data signals to the data lines D during a frame period when the display device 1000 is driven at a first driving frequency. In this case, the data signals to be supplied to the data lines D may be synchronized with scan signals to be supplied to first scan lines S1 and second scan lines S2.

The data driver 500 may supply data signals to the data lines D during a first period in which scan signals are supplied to the second scan lines S2 during a single frame period, and may supply an arbitrary reference voltage to the data lines D during a second period, but not the first period. For example, the reference voltage may be set to a specific voltage within a voltage range of data signals. For example, the reference voltage may be set to a data voltage having a black gray scale. Furthermore, as a horizontal period passes or a frame period passes, the reference voltage may be changed within the voltage range of the data signals.

In addition, the first period may be a period in which scan signals are supplied to all of the first scan lines S1 and the second scan lines S2. The second period may be a period in which scan signals are supplied to the first scan lines S1, but not the second scan lines S2.

The first scan driver 200 may supply scan signals to the first scan lines S1 in response to the first gate start pulse GSP1. For example, the first scan driver 200 may sequentially supply scan signals to the first scan lines S1. In this case, a scan signal to be supplied from the first scan driver 200 may be set to a gate-on voltage so that a transistor included in the pixel PXL may be turned on.

The first scan driver 200 may supply scan signals to the first scan lines S1 at a constant first frequency regardless of a driving frequency of an image frame (or a frame frequency) of the display device 1000. In this case, the first frequency may correspond to an output frequency of the first gate start pulse GSP1 to be supplied from the timing controller 600 to the first scan driver 200.

Furthermore, the first frequency at which the first scan driver 200 supplies the scan signals may be greater than the driving frequency. In an exemplary embodiment of the present invention, the driving frequency may be set to a submultiple of the first frequency. For example, the first frequency may be set to approximately twice the maximum driving frequency of the display device 1000. In the case where the maximum driving frequency of the display device 1000 is approximately 120 Hz, the first frequency may be set to 240 Hz. Therefore, in each frame period, a plurality of scanning operations of sequentially outputting scan signals to the first scan lines S1 may be repeated at a predetermined cycle. In other words, in each frame period, scan signals to be supplied to the respective first scan lines S may be repeatedly supplied at each predetermined cycle.

For example, at all driving frequency conditions at which the display device 1000 may be driven, the first scan driver 200 may perform a scanning operation once during a first period, and perform a scanning operation at least once depending on the driving frequency during a second period. In other words, during the first period, scan signals are sequentially output once to the respective first scan lines S1. During the second period, scan signals may be sequentially output at least once to the respective first scan lines S1. In other words, during the second period, the scan signals may be sequentially output two or more times to the respective first scan lines S1.

In addition, if the driving frequency is reduced, the number of times the first scan driver 200 repeatedly performs supplying scan signals to the respective first scan lines S1 during each frame period may be increased.

The second scan driver 300 may supply scan signals to the second scan lines S2 in response to the second gate start pulse GSP2. For example, the second scan driver 300 may sequentially supply scan signals to the second scan lines S2. In this case, a scan signal to be supplied from the second scan driver 300 may be set to a gate-on voltage so that a transistor included in the pixel PXL may be turned on.

The second scan driver 300 may supply scan signals to the second scan lines S2 at a frequency (e.g., a second frequency) equal to the driving frequency corresponding to the image frame (or the frame frequency) of the display device 1000. In an exemplary embodiment of the present invention, the second frequency may correspond to an output frequency of the second gate start pulse GSP2 to be supplied from the timing controller 600 to the second scan driver 300.

The second frequency, which is substantially the same as the driving frequency, may be set to a submultiple of the first frequency.

The second scan driver 300 may supply scan signals to the second scan lines S2 during a first period of each frame. For example, the second scan driver 300 may supply at least one scan signal to each of the second scan lines S2 during the first period. In this case, a scan signal to be supplied to an i-th first scan line S1*i* during the first period may overlap with a scan signal to be supplied to an i-th second scan line S2*i*.

The emission driver 400 may supply emission control signals to emission control lines E in response to the emission start pulse ESP. For example, the emission driver 400 may sequentially supply the emission control signals to the emission control lines E. If the emission control signals are sequentially supplied to the emission control lines E, the pixels PXL may be not-emitted on a horizontal line basis. In other words, the pixels PXL may not emit light. For this operation, the emission control signal may be set to a gate-off voltage so that transistors included in the pixels PXL may be turned off. In an exemplary embodiment of the present invention, the emission driver 400 may supply an emission control signal to an i-th emission control line Ei such that the emission control signal overlaps with scan signals supplied to an i−1-th first scan line S1*i*−1 (and/or an i−1-th second scan line S2*i*−1, an i-th first scan line S1*i* (and/or an i-th second scan line S2*i*), and an i+1-th first scan line S1*i*+1 (and/or an i+1-th second scan lines S2*i*+1).

In an exemplary embodiment of the present invention, in the same manner as the first scan driver 200, the emission driver 400 may supply emission control signals to the emission control lines E at the first frequency. Hence, in each frame period, emission control signals to be supplied to the respective emission control lines E may be repeatedly supplied at each cycle.

When the driving frequency is reduced, the number of times the emission driver 400 repeatedly performs an operation of supplying emission control signals to the respective emission control lines E during each frame period may be increased.

The pixel unit 100 may include pixels PXL which are coupled with the data lines D, the first and second scan lines S1 and S2, and the emission control lines E. The pixels PXL may be supplied with voltages of a first power supply VDD, a second power supply VSS, and an initialization power supply Vint from external devices.

Each pixel PXL may be selected when a scan signal is supplied to the first and second scan lines S1 and S2 coupled with the pixel PXL, and when a data signal is supplied to the data line D connected with the pixel PXL. The pixel PXL supplied with the data signal may control, in response thereto, the amount of current flowing from the first power supply VDD to the second power supply VSS via a light emitting element. The light emitting element may generate light having a luminance in response to the amount of current. The light generated by the light emitting element may be predetermined. The time for which each pixel PXL emits light may be controlled by an emission control signal supplied from the emission control line E coupled with the pixel PXL.

In addition, the pixels PXL may be coupled to one or more first scan lines S1, one or more second scan lines S2, and one or more emission control lines E depending on the structure of a pixel circuit. In other words, in an exemplary embodiment of the present invention, signal lines such as the first and second scan lines S1 and S2, the emission control lines E, and the data lines D to be coupled to the pixel PXL may be variously arranged depending on the circuit structure of the pixel PXL.

Figure 2:
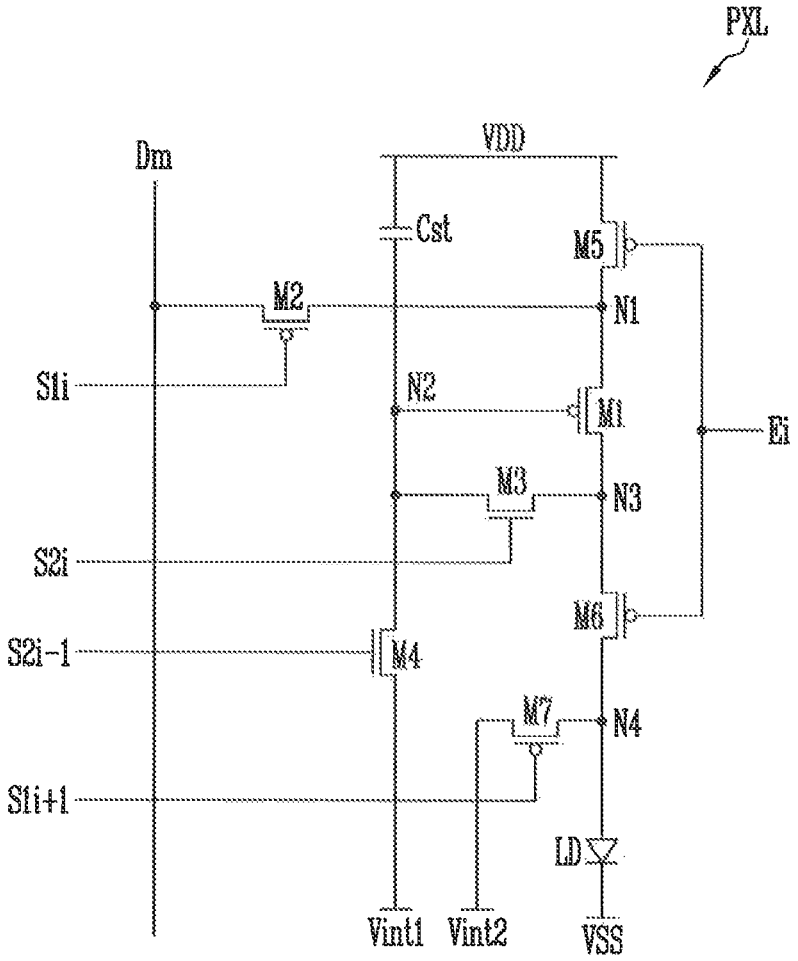
FIG. 2 is a circuit diagram illustrating a pixel included in the display device of FIG. 1, according to an exemplary embodiment of the present invention.

FIG. 2 is a circuit diagram illustrating a pixel PXL included in the display device 1000 of FIG. 1, according to an exemplary embodiment of the present invention.

In FIG. 2, for the sake of description, there is illustrated a pixel PXL that is disposed on an i-th horizontal line and coupled with an m-th data line Dm.

Referring to FIG. 2, the pixel PXL may include a light emitting element LD, first, second, third, fourth, fifth, sixth and seventh transistors M1, M2, M3, M4, M5, M6 and M7, and a storage capacitor Cst.

The light emitting element LD may include a first electrode (either an anode electrode or a cathode electrode) coupled to a fourth node N4, and a second electrode (the other one of the cathode electrode and the anode electrode) coupled to the second power supply VSS. The light emitting element LD may emit light having a predetermined luminance corresponding to a current supplied from the first transistor ML.

In an exemplary embodiment of the present invention, the light emitting element LD may be an organic light emitting diode including an organic light emitting layer. In an exemplary embodiment of the present invention, the light emitting element LD may be an inorganic light emitting element formed of inorganic material. The light emitting element LD may have a shape in which a plurality of inorganic light emitting elements are coupled in parallel and/or series between the second power supply VSS and the fourth node N4.

The first transistor (or a driving transistor) M1 may include a first electrode coupled to a first node N1, and a second electrode coupled to a third node N3. A gate electrode of the first transistor M1 is coupled to a second node N2. The first transistor M1 may control, in response to the voltage of the second node N2, the amount of current flowing from the first power supply VDD to the second power supply VSS via the light emitting element LD. To accomplish this, the first power supply VDD may be set to a voltage higher than the second power supply VSS.

The second transistor M2 may be coupled between the data line Dm and the first node N1. A gate electrode of the second transistor M2 may be coupled to the i-th first scan line S1*i*. When a scan signal is supplied to the i-th first scan line S1*i*, the second transistor M2 may be turned on to electrically couple the data line Dm with the first node N1.

The third transistor M3 may be coupled between the second electrode (e.g., the third node N3) of the first transistor M1 and the second node N2. A gate electrode of the third transistor M3 may be coupled to the i-th second scan line S2*i*. When a scan signal is supplied to the i-th second scan line S2*i*, the third transistor M3 may be turned on to electrically connect the second electrode of the first transistor M1 to the second node N2. Therefore, if the third transistor M3 is turned on, the first transistor M1 may be connected in the form of a diode.

The fourth transistor M4 is coupled between the second node N2 and a first initialization power supply Vint1. A gate electrode of the fourth transistor M4 is coupled to the i−1-th second scan line S2*i*−1. When a scan signal is supplied to the i−1-th second scan line S2*i*−1, the fourth transistor M4 is turned on so that the voltage of the first initialization power supply Vint1 may be supplied to the second node N2. The voltage of the first initialization power supply Vint1 is set to a voltage lower than a data signal to be supplied to the data line Dm.

Therefore, when the fourth transistor M4 is turned on, the gate voltage of the first transistor M1 may be initialized to the voltage of the first initialization power supply Vint1, and the first transistor M1 may have an on-bias state (e.g., the first transistor M1 may be initialized to an on-bias state).

The fifth transistor M5 is coupled between the first power supply VDD and the first node N1. A gate electrode of the fifth transistor M5 may be coupled to the emission control line Ei. The fifth transistor M5 may be turned off when an emission control signal is supplied to the emission control line Ei, and may be turned on in the other cases.

The sixth transistor M6 may be coupled between the second electrode (e.g., the third node N3) of the first transistor M1 and the first electrode (e.g., the fourth node N4) of the light emitting element LD. A gate electrode of the sixth transistor M6 may be coupled to the emission control line Ei. The sixth transistor M6 may be turned off when an emission control signal is supplied to the emission control line Ei, and may be turned on in the other cases.

The seventh transistor M7 may be coupled between the first electrode (e.g., the fourth node N4) of the light emitting element LD and a second initialization power supply Vint2. A gate electrode of the seventh transistor M7 may be coupled to the i+1-th first scan line S1*i*+1. When a scan signal is supplied to the i+1-th first scan line S1*i*+1, the seventh transistor M7 is turned on so that the voltage of the second initialization power supply Vint2 may be supplied to the first electrode of the light emitting element LD.

However, this configuration is only for illustrative purposes, and the gate electrode of the seventh transistor M7 may be coupled to the i−1-th first scan line S1*i*−1 or the i-th first scan line S1*i*.

If the voltage of the second initialization power supply Vint2 is supplied to the first electrode of the light emitting element LD, a parasitic capacitor of the light emitting element LD may be discharged. As a residual voltage charged into the parasitic capacitor is discharged (e.g., removed), an undesired fine emission may be prevented. Therefore, the black expression performance of the pixel PXL may be enhanced.

The first initialization power supply Vint1 and the second initialization power supply Vint2 may generate different voltages. In other words, a voltage (e.g., the first initialization power supply Vint1) of initializing the second node N2 and a voltage (e.g., the second initialization power supply Vint2) of initializing the fourth node N4 may be set to different values.

In a low-frequency driving mode having a relatively long frame period, if the voltage of the first initialization power supply Vint1 supplied to the second node N2 is excessively low, the hysteresis of the first transistor M1 may excessively vary during the frame period. Such hysteresis may cause a flicker phenomenon in the low-frequency driving mode. Therefore, in the low-frequency driving mode of the display device 1000, the voltage of the first initialization power supply Vint1 may be higher than the voltage of the second power supply VSS.

However, if the voltage of the second initialization power supply Vint2 supplied to the fourth node N4 is higher than a predetermined reference value, the voltage of the parasitic capacitor of the light emitting element LD may be charged rather than discharged. Therefore, the voltage of the second initialization power supply Vint2 is to be lower than the voltage of the second power supply VSS.

In various exemplary embodiments of the present invention, the pixels PXL included in the display device 1000 may be coupled with the first initialization power supply Vint1 and the second initialization power supply Vint2 that provide different voltages. Therefore, since a voltage of initializing the first transistor M1 and a voltage of initializing the light emitting element LD are independently determined, a flicker phenomenon or emission error may be prevented or mitigated.

The storage capacitor Cst may be coupled between the first power supply VDD and the second node N2. The storage capacitor Cst may store a voltage applied to the second node N2.

The first transistor M1, the second transistor M2, the fifth transistor M5, the sixth transistor M6, and the seventh transistor M7 each may be formed of a poly-silicon semiconductor transistor. For example, the first transistor M1, the second transistor M2, the fifth transistor M5, the sixth transistor M6, and the seventh transistor M7 each may include, as an active layer (e.g., a channel), a poly-silicon semiconductor layer formed through a low temperature poly-silicon (LTPS) process. Furthermore, the first transistor M1, the second transistor M2, the fifth transistor M5, the sixth transistor M6, and the seventh transistor M7 each may be a P-type transistor. Therefore, a gate-on voltage for turning on the first transistor M1, the second transistor M2, the fifth transistor M5, the sixth transistor M6, or the seventh transistor M7 may have a logic low level.

Since a poly-silicon semiconductor transistor has a high response speed, the poly-silicon semiconductor transistor may be applied in a switching element in which a high-speed switching operation is employed.

The third and fourth transistors M3 and M4 each may be formed of an oxide semiconductor transistor. For example, each of the third and fourth transistors M3 and M4 may be an N-type oxide semiconductor transistor, and include an oxide semiconductor layer as an active layer. Hence, a gate-on voltage for turning on the third or fourth transistor M3 or M4 may have a logic high level.

An oxide semiconductor transistor may be produced through a low-temperature process, and have low charge mobility compared to that of the poly-silicon semiconductor transistor. In other words, the oxide semiconductor transistor may have excellent off-current characteristics. Therefore, if each of the third transistor M3 and the fourth transistor M4 is formed of an oxide semiconductor transistor, leakage current from the second node N2 may be minimized. Therefore, the display quality of the display device 1000 may be enhanced.

Figure 3A:
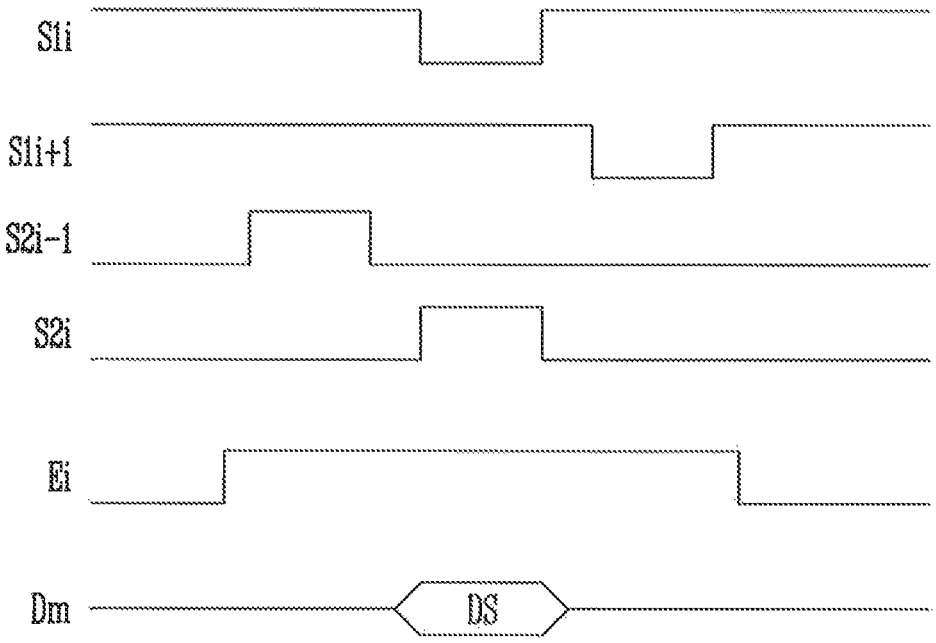
FIG. 3A is a timing diagram illustrating an operation of the pixel of FIG. 2, according to an exemplary embodiment of the present invention.

FIG. 3A is a timing diagram illustrating an operation of the pixel PXL of FIG. 2, according to an exemplary embodiment of the present invention.

Referring to FIGS. 2 and 3A, the pixel PXL may be supplied with signals for displaying an image during a first period. The first period may include a period in which a data signal DS substantially corresponding to an output image is input.

A gate-on voltage of a scan signal to be supplied to each of the second scan lines S2*i* and S2*i*−1 coupled to the third and fourth transistors M3 and M4 each of which is an N-type transistor may have a logic high level. A gate-on voltage of a scan signal to be supplied to each of the first scan lines S1*i* and S1*i*+1 coupled to the first, second, fifth, sixth, and seventh transistors M1, M2, M5, M6, and M7 each of which is a P-type transistor may have a logic low level.

An emission control signal is supplied to the emission control line Ei. If the emission control signal is supplied to the emission control line Ei, the fifth and sixth transistors M5 and M6 may be turned off. If the fifth and sixth transistors M5 and M6 are turned off, the pixel PXL may be set to a non-emission state. In other words, the pixel PXL may not emit light when the fifth and sixth transistors M5 and M6 are turned off.

Thereafter, a scan signal is supplied to the i−1-th second scan line S2*i*−1. When the scan signal is supplied to the i−1-th second scan line S2*i*−1, the fourth transistor M4 may be turned on. When the fourth transistor M4 is turned on, the voltage of the first initialization power source Vint1 is supplied to the second node N2.

Thereafter, scan signals are supplied to the i-th first scan line S1*i* and the i-th second scan line S2*i*. When a scan signal is supplied to the i-th second scan line S2*i*, the third transistor M3 may be turned on. When the third transistor M3 is turned on, the first transistor M1 may be connected in the form of a diode, and the threshold voltage of the first transistor M1 may be compensated.

When a scan signal is supplied to the i-th first scan line S1, the second transistor M2 may be turned on. When the second transistor M2 is turned on, a data signal DS may be supplied from the data line Dm to the first node N1. In this case, since the second node N2 has been initialized to the voltage of the first initialization power Vint1 that is lower than the data signal DS (e.g., the second node N2 has been initialized to an on-bias state), the first transistor M1 may be turned on.

When the first transistor M1 is turned on, the data signal DS supplied to the first node N1 may be supplied to the second node N2 via the first transistor M1 that is connected in the form of a diode. Then, a voltage corresponding to the data signal DS and the threshold voltage of the first transistor M1 may be applied to the second node N2. In this case, the storage capacitor Cst may store a voltage corresponding to the second node N2.

Thereafter, a scan signal is supplied to the i+1-th first-scan line S1*i*+1. When a scan signal is supplied to the i+1-th first scan line S1*i*+1, the seventh transistor M7 may be turned on. When the seventh transistor M7 is turned on, the voltage of the second initialization power supply Vint2 may be supplied to the first electrode (e.g., the fourth node N4) of the light emitting element LD. Therefore, the residual voltage that remains in the parasitic capacitor of the light emitting element LD may be discharged.

Thereafter, the supply of the emission control signal to the emission control line Ei may be suspended. The emission control signal may drop from a high level to a low level when it is suspended. When the supply of the emission control signal to the emission control line Ei is suspended, the fifth and sixth transistors M5 and M6 are turned on. In this case, the first transistor M1 may control a driving current flowing to the light emitting element LD in response to the voltage of the second node N2. The light emitting element LD may generate light having a luminance corresponding to the amount of current, e.g., the driving current.

Although, for the sake of description, FIG. 3A illustrates that a scan signal is supplied to each of the first and second scan lines S1 and S2 during the first period, the present invention is not limited thereto. For example, a plurality of scan signals may be supplied to each of the first and second scan lines S1 and S2. In this case, an operating process is substantially the same as that of FIG. 3A, and thus, a detailed description thereof will be omitted. In the following descriptions, it is assumed that a scan signal is supplied to each of the first and second scan lines S1 and S2.

The above-mentioned operation in the first period may be implemented by scan signals supplied to the second scan lines S2*i*−1 and S2*i*, and may be synchronized with the frequency of the second scan driver 300.

Figure 3B:
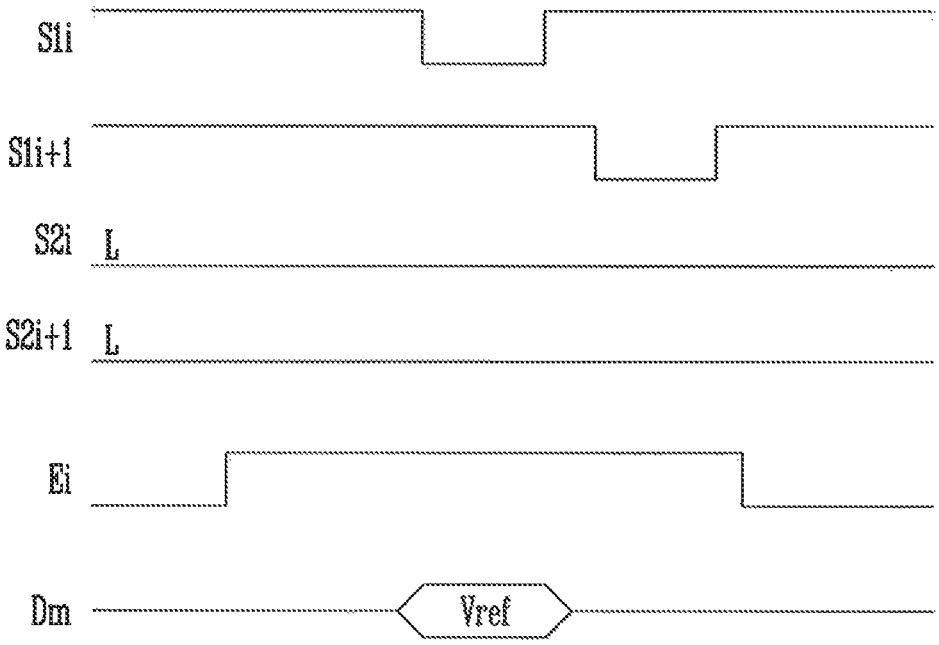
FIG. 3B is a timing diagram illustrating an operation of the pixel of FIG. 2, according to an exemplary embodiment of the present invention.

FIG. 3B is a timing diagram illustrating an operation of the pixel of FIG. 2, according to an exemplary embodiment of the present invention.

Referring to FIGS. 2 and 3B, to maintain the luminance of an image that is output during the first period, the pixel PXL may apply a predetermined reference voltage Vref to the first electrode (e.g., a source electrode) of the first transistor M1 during the second period.

The timing diagram of FIG. 3B illustrates a period of the operation during the second period.

For the sake of description, the driving period of FIG. 3B is a self-scan period of changing characteristics of the first transistor M1. The second period may include at least one self-scan period depending on a driving frequency.

In an exemplary embodiment of the present invention, during the second to period, a scan signal is supplied to neither the third transistor M3 nor the fourth transistor M4. For example, during the second period, a scan signal to be supplied to the i-th second scan line S2*i* and the i+1-th second scan line S2*i*+1 may have a logic low level L.

Since the third and fourth transistors M3 and M4 remain turned off, the gate voltage (e.g., the second node N2) of the first transistor M1 may not be affected by an operation performed during the second period.

First, as shown in FIG. 3B, an emission control signal is supplied to the emission control line Ei. Here, the emission control signal goes from low to high. If the emission control signal is supplied to the emission control line Ei, the fifth and sixth transistors M5 and M6 are turned off. If the fifth and sixth transistors M5 and M6 are turned off, the pixel PXL is set to a non-emission state.

Thereafter, a scan signal is supplied to the i-th first scan line S1*i*, and the second transistor M2 may be turned on. As can be seen, the second transistor M2 is turned on when the scan signal supplied to the i-th first scan line S1*i* goes low. When the second transistor M2 is turned on, a reference voltage Vref is supplied from the data line Dm to the first node N1. In this case, the reference voltage Vref may be set to a specific voltage within a voltage range of data signals. Hence, the voltage of the first node N1 is changed from the voltage of the first power supply VDD to another voltage, and a characteristic curve of the first transistor M1 may be changed. Therefore, after the first period in which the data signal DS is supplied has passed, a variation in luminance due to hysteresis of the first transistor M1 may be mitigated.

In the case where the first frequency of driving the first scan line S1 and the emission control line E is set to 240 Hz and the driving frequency (e.g., the frequency of driving the second scan line S2) of displaying an actual image is set to 80 Hz or less, if the characteristics of the first transistor M1 are fixed in a specific state during each frame period, a flicker phenomenon may occur due to hysteresis characteristics.

On the other hand, in accordance with the present invention, if the reference voltage Vref is supplied to the first electrode (e.g., the source electrode) of the is first transistor M1 during the second period, the first transistor M1 enters an on-bias state, and the characteristics of the first transistor M1 may be changed. Consequently, the characteristics of the first transistor M1 may be prevented from being fixed in a specific state and thus deteriorated. Particularly, in the case where the second period is increased as the driving frequency is reduced, the reference voltage Vref may be periodically supplied to the first electrode of the first transistor M1 by the first scan driver 200.

Thereafter, a scan signal is supplied to the i+1-th first-scan line S1*i*+1. When a scan signal is supplied to the i+1-th first scan line S1*i*+1 at the low level, the seventh transistor M7 may be turned on. When the seventh transistor M7 is turned on, the voltage of the second initialization power supply Vint2 may be supplied to the first electrode (e.g., the fourth node N4) of the light emitting element LD. Thereby, the residual voltage that remains in the parasitic capacitor of the light emitting element LD may be discharged.

Thereafter, the supply of the emission control signal to the emission control line Ei may be suspended. If the supply of the emission control signal to the emission control line Ei is suspended, the fifth and sixth transistors M5 and M6 are turned on. In this case, the first transistor M1 may control a driving current flowing to the light emitting element LD in response to the voltage of the second node N2. The light emitting element LD may generate light having a luminance corresponding to the amount of the driving current.

The above-mentioned operation in the second period may be implemented by scan signals supplied to the first scan lines S1*i* and S1*i*+1, and may be synchronized with the frequency of the first scan driver 200.

Figure 4:
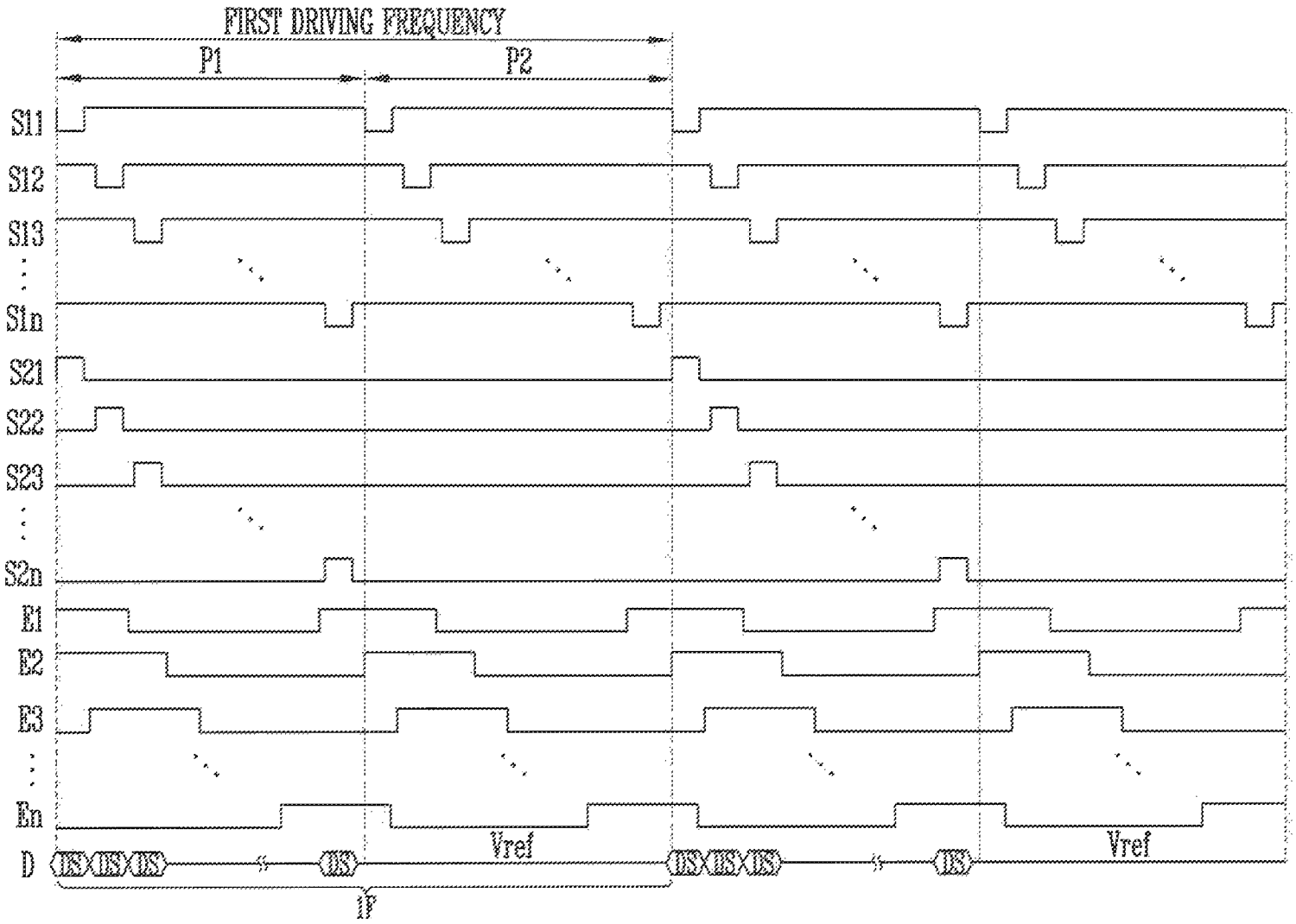
FIG. 4 is a timing diagram illustrating a method of driving the display device of FIG. 1 when the display device is driven at a first driving frequency, according to an exemplary embodiment of the present invention.

FIG. 4 is a timing diagram illustrating a method of driving the display device 1000 of FIG. 1 when the display device 1000 is driven at a first driving frequency, according to an exemplary embodiment of the present invention.

Here, the first driving frequency may be a maximum driving frequency that can be implemented by the display device 1000. For example, the first driving frequency may be set to a high frequency of 120 Hz or more. The first driving frequency may pertain to a cycle in which data signals DS are supplied to the data lines D. Each frame period 1F may correspond to a supply cycle of data signals DS and the first driving frequency.

Referring to FIGS. 1 and 4, when the display device 1000 is driven at the first driving frequency, each frame period 1F may include a first period P1 and a second period P2.

In an exemplary embodiment of the present invention, when the display device 1000 is driven at the first driving frequency, the length of the first period P may be substantially the same as that of the second period P2.

In an exemplary embodiment of the present invention, the first scan driver 200 may sequentially supply scan signals to the first scan lines S11 to S1*n* at a first frequency. The emission driver 400 may sequentially supply emission control signals to the emission control lines E1 to En at the first frequency. In this case, the first frequency may be approximately double the first driving frequency.

In an exemplary embodiment of the present invention, the second scan driver 30 may sequentially supply scan signals to the second scan lines S21 to S2*n* at a second frequency equal to the first driving frequency.

During the first period P1, scan signals are sequentially supplied to the first scan lines S11 to S1*n* and the second scan lines S21 to S2*n*. In this case, a scan signal supplied to an i-th first scan line S1*i* may overlap with a scan signal supplied to an i-th second scan line S2*i*. For example, the scan signal applied to the first scan line S11 may overlap with the scan signal applied to the second scan line S21.

Furthermore, during the first period P1, emission control signals are sequentially supplied to the emission control lines E1 to En. In this case, an emission control signal supplied to an i-th emission control line Ei may overlap with scan signals supplied to an i−1-th first scan line S1*i*−1, the i-th first scan line S1*i*, and an i+1-th first scan line S1*i*+1. Data signals DS are supplied to the data lines D in synchronization with the scan signals. Hence, during the first period P1, voltages corresponding to the data signals DS are stored in the respective pixels PXL, and the pixels PXL may emit light based on the stored voltages.

During the second period P2, scan signals are respectively supplied to the first scan lines S11 to S1*n*. In addition, during the second period P2, scan signals are not supplied to the second scan lines S21 to S2*n*. Furthermore, during the second period P2, emission control signals are respectively supplied to the emission control lines E1 to En. In this case, an emission control signal supplied to an i-th emission control line Ei may overlap with scan signals supplied to the i−1-th first scan line S1*i*−1, the i-th first scan line S1*i*, and the i+1-th first scan line S1*i*+1.

During the second period P2, the reference voltage Vref may be supplied to each of the data lines D. In other words, data signals DS are supplied to the data lines D only during the first period P1, therefore power consumption may be reduced.

As described with reference to FIG. 3A, during the first period P1, voltages corresponding to the data signals DS are stored in the respective pixels PXL, and the pixels PXL may emit light based on the stored voltages.

As described with reference to FIG. 3B, during the second period P2, a predetermined on-bias may be applied to the first transistor M1 by a scan signal that is supplied to each of the first scan lines S11 to S1*n*. Therefore, the hysteresis of the first transistor M1 in the first frame period 1F may be improved.

Since the first frequency, which is an output frequency of the first scan driver 200 and the emission driver 400, is set to a value greater than the driving frequency of the display device 1000, it is possible to support the output of images having various driving frequencies. For example, the driving frequency of the display device 1000 may correspond to submultiples of the first frequency.

Figure 5:
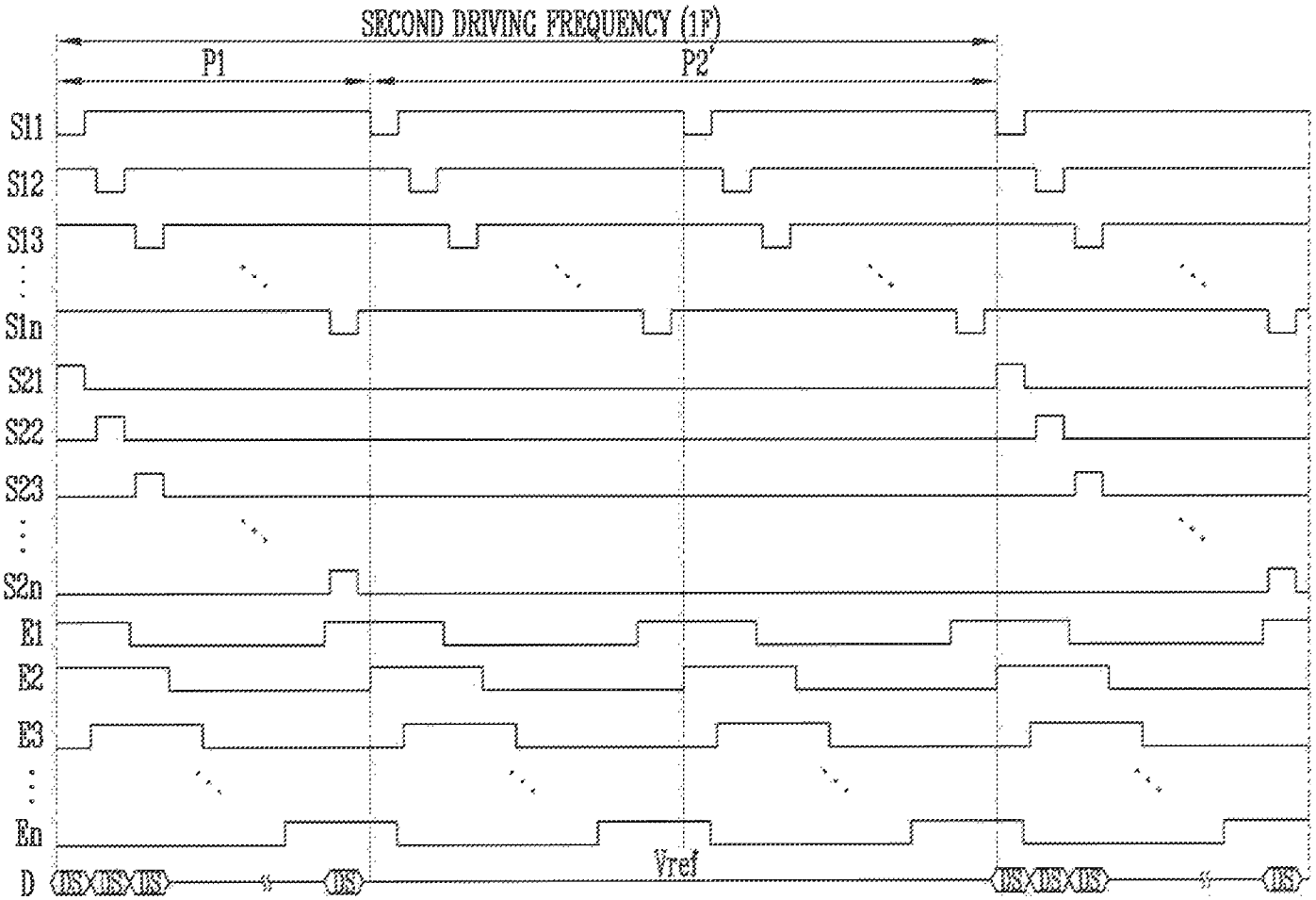
FIG. 5 is a timing diagram illustrating a method of driving the display device of FIG. 1 when the display device is driven at a second driving frequency, according to an exemplary embodiment of the present invention.

FIG. 5 is a timing diagram illustrating a method of driving the display device 1000 of FIG. 1 when the display device 1000 is driven at a second driving frequency, according to an exemplary embodiment of the present invention.

Referring to FIGS. 1, 4 and 5, when the display device 1000 is driven at the second driving frequency, each frame period 1F may include a first period P1 and a second period P2'.

An operation in the first period P1 of FIG. 5 is substantially the same as the operation in the first period P1 described with reference to FIG. 4; therefore, a repetitive description thereof will be omitted.

In FIG. 5, the first frequency may be set to approximately 240 Hz, and the second driving frequency may be set to a frequency less than 100 Hz. Furthermore, the second period P2' may be longer than the first period P1. In an exemplary embodiment of the present invention, the length of the second period P2' may correspond to an integer multiple of the length of the first period P1. For example, FIG. 5 illustrates an example in where the second driving frequency is approximately 80 Hz.

In an exemplary embodiment of the present invention, the first scan driver 200 and the emission driver 400 may respectively drive the first scan lines S11 to S1*n* and the emission control lines E1 to En at the first frequency regardless of the driving frequency of the display device 1000. In this case, the first frequency may remain constant. The second scan driver 300 may drive the second scan lines S21 to S2*n* at the second frequency substantially equal to the second driving frequency.

During the second period P2', a plurality of scan signals are supplied to each of the first scan lines S11 to S1*n*. In this case, the scan signals to be supplied to each of the first scan lines S11 to S1*n* may be supplied at a predetermined cycle. For example, during the second period P2', the scan signals may be sequentially and repeatedly supplied to the first scan lines S11 to S1*n* a plurality of times. In FIG. 5 the scan signals are supplied to the first scan lines S11 to S1*n* two times, but the present invention is not limited thereto. For example, the scan signals may be supplied to the first scan lines S11 to S1*n* more than two times.

Furthermore, during the second period P2', a plurality of emission control signals are supplied to each of the emission control lines E1 to En. The emission control signals may be supplied at the substantially same cycle as that of the scan signals supplied to the first scan lines S11 to S1*n*. During the second period P2', the reference voltage Vref may be supplied to each of the data lines D.

Hence, during the second period P2', an on-bias may be applied to the first transistor M1 of each of the pixels PXL, periodically (e.g., at the first frequency). Therefore, in response to various driving frequencies, the hysteresis of the first transistor M1 in the frame period 1F may be improved.

Figure 6A:
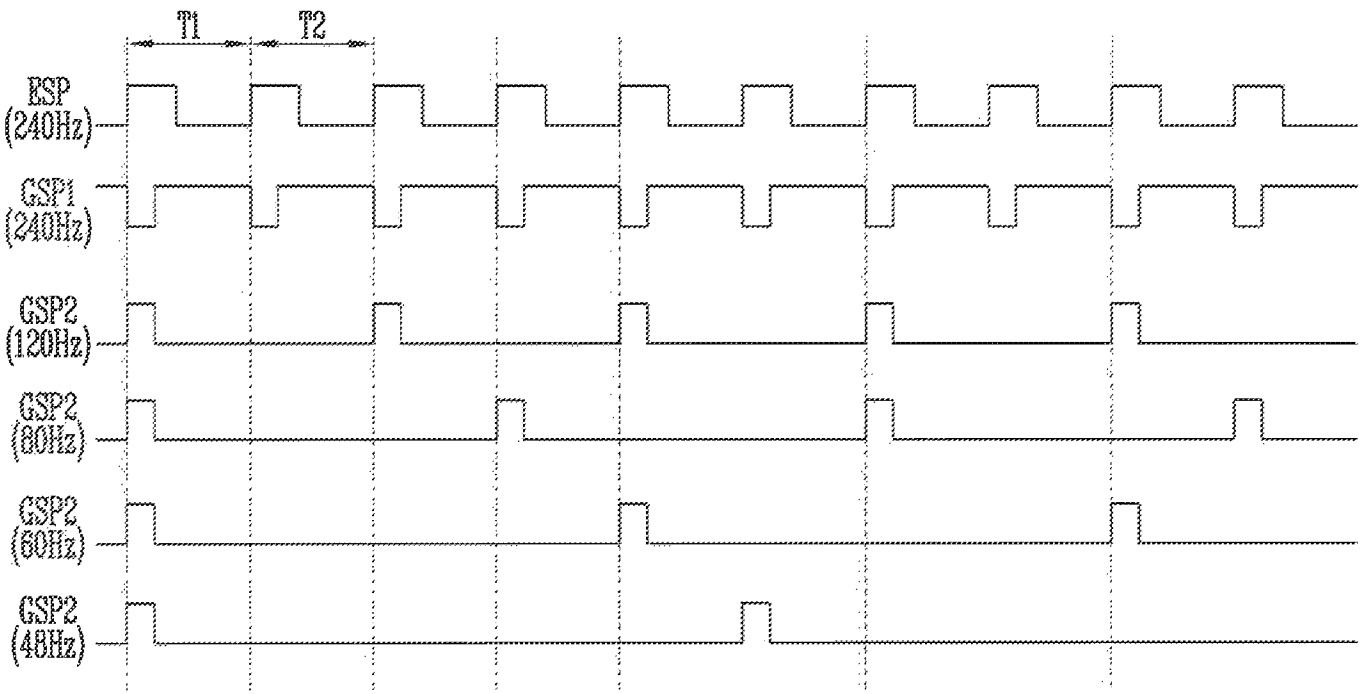
FIG. 6A is a timing diagram illustrating gate start pulses to be supplied, depending on the driving frequency, to an emission driver and scan drivers that are included in the display device of FIG. 1, according to an exemplary embodiment of the present invention.
Figure 6B:
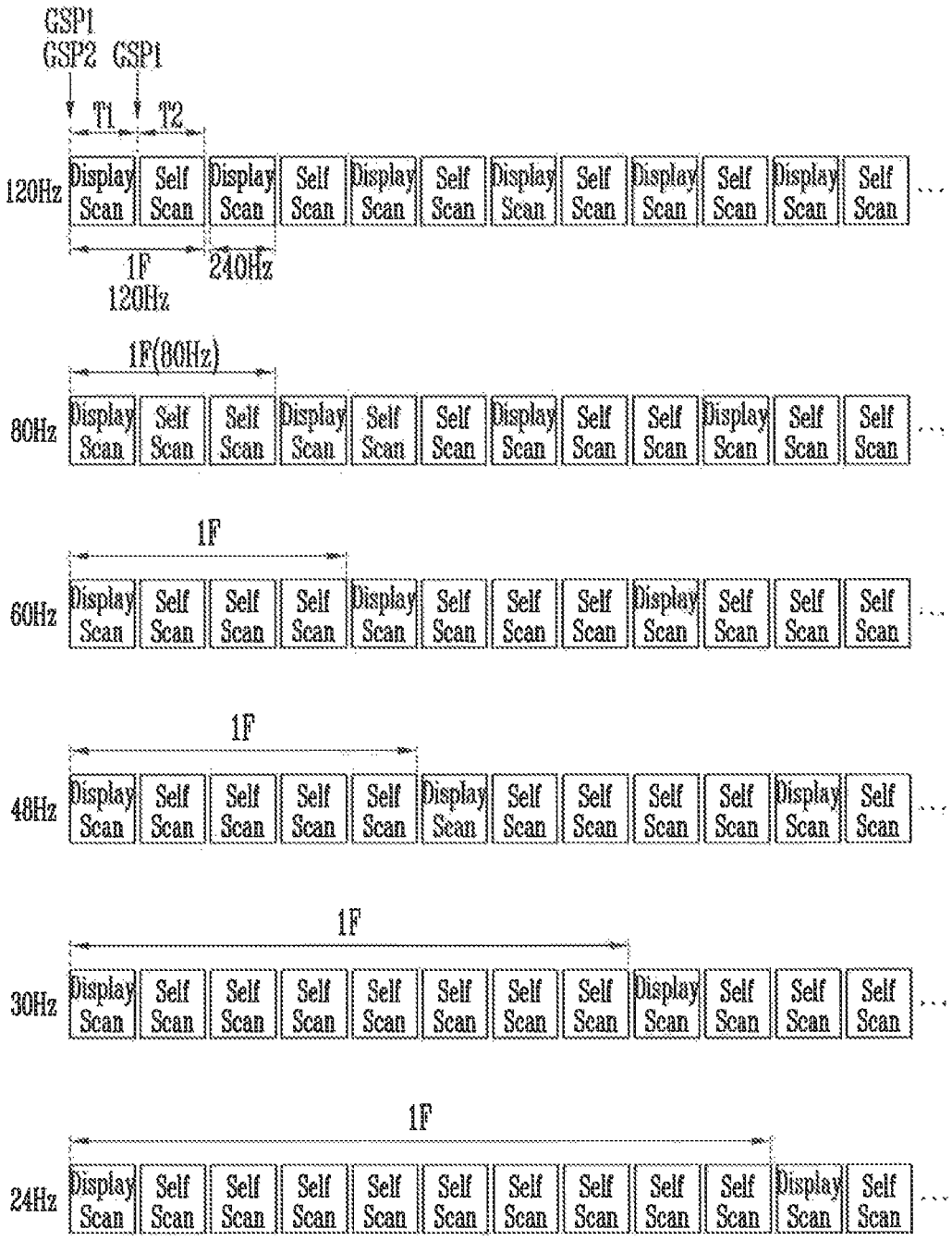
FIG. 6B is a diagram illustrating a method of driving the display device of FIG. 1 depending on the driving frequency, in accordance with an exemplary embodiment of the present invention.

FIG. 6A is a timing diagram illustrating gate start pulses to be supplied, depending on the driving frequency, to an emission driver and scan drivers that are included in the display device 1000 of FIG. 1, according to an exemplary embodiment of the present invention. FIG. 6B is a diagram illustrating a method of driving the display device depending on the driving frequency, in accordance with an exemplary embodiment of the present invention.

Referring to FIGS. 1, 2, 4, 5, 6A, and 6B, the output frequency of the second gate start pulse GSP2 may vary depending on the driving frequency.

In an exemplary embodiment of the present invention, the pulse widths of the first and second gate pulses GSP1 and GSP2 may be substantially the same as each other. The pulse width of the emission start pulse ESP may be greater than the pulse width of the first and second gate pulses GSP1 and GSP2.

In an exemplary embodiment of the present invention, the timing controller 600 may output the emission start pulse ESP and the first gate start pulse GSP1 at a constant frequency (e.g., the first frequency), regardless of the driving frequency. For example, the output frequency of the emission start pulse ESP and the first gate start pulse GSP1 may be set to be double the maximum driving frequency of the display device 1000.

The timing controller 600 may output the second gate start pulse GSP2 at is the same frequency (e.g., the second frequency) as the driving frequency. Each frame period of the display device 1000 may be determined by the output cycle of the second gate start pulse GSP2.

In an exemplary embodiment of the present invention, the first period P1 of FIGS. 6A and 6B may be a display scan period T1 in which all of the emission start pulse ESP, the first gate start pulse GSP1, and the second gate start pulse GSP2 are output. For example, during the display scan period T1, each of the pixels PXL may perform the operation of FIG. 3A. During the display scan period T1, each of the pixels PXL may store data signals DS corresponding to images to be displayed.

In an exemplary embodiment of the present invention, the second period P2 or P2' of FIGS. 6A and 6B may include at least one self-scan period T2 in which the emission start pulse ESP and the first gate start pulse GSP1 are output. For example, during the self-scan period T2, each of the pixels PXL may perform the operation of FIG. 3B. During the self-scan period T2, a predetermined reference voltage Vref may be applied to the first electrode of the first transistor M1 of each of the pixels PXL.

In an exemplary embodiment of the present invention, the length of the display scan period T1 is substantially the same as that of the self-scan period T2. However, the number of self-scan periods T2 included in the second period P2 or P2' of each frame period 1F may depend on the driving frequency.

As illustrated in FIGS. 6A and 6B, in the case where the display device 1000 is driven at the first driving frequency of 120 Hz, the number of second gate start pulses GSP2 to be supplied during each frame period 1F may be half of the number of first gate start pulses GSP1. Therefore, in the case where the display device 1000 is driven at the first driving frequency, each frame period 1F may include one display scan period T1 and one self-scan period T2.

The emission start pulse ESP may be supplied at the same frequency as that of the first gate start pulse GSP1. In the case where the display device 1000 is driven at the first driving frequency of 120 Hz, each of the pixels PXL may alternately repeat emission (e.g., display scan) and non-emission (e.g., self scan) two times during each frame period 1F.

In the case where the display device 1000 is driven at the second driving frequency of 80 Hz, the number of second gate start pulses GSP2 to be supplied during each frame period 1F may be ⅓ of the number of first gate start pulses GSP1. Therefore, in the case where the display device 1000 is driven at the second driving frequency, each frame period 1F may include one display scan period T1 and two self-scan periods T2. Here, each of the pixels PXL may alternately repeat emission and non-emission three times during each frame period 1F.

In the case where the display device 1000 is driven at a third driving frequency of 48 Hz, the number of second gate start pulses GSP2 to be supplied during each frame period 1F may be ⅕ of the number of first gate start pulses GSP1. Therefore, in the case where the display device 1000 is driven at the third driving frequency, each frame period 1F may include one display scan period T1 and four self-scan periods T2. Hence, during the second period P2, scan signals may be supplied four times to each of the first scan lines S11 to S1$n$. Here, each of the pixels PXL may alternately repeat emission and non-emission four times during each frame period 1F In a manner similar to that described above, the display device 1000 may be driven at a driving frequency of 60 Hz, 30 Hz, 24 Hz, etc. by adjusting the number of self-scan periods T2 included in the second period P2 or P2'. In other words, the display device 1000 may support various image frames at frequencies corresponding to submultiples of the first frequency.

Furthermore, since the driving frequency is reduced, the number of self-scan period T2 is increased. Thus, a predetermined on-bias may be periodically applied to the first transistor M1. Consequently, luminance reduction and high flicker visibility in a low-frequency driving mode may not occur or be mitigated.

Figure 7:
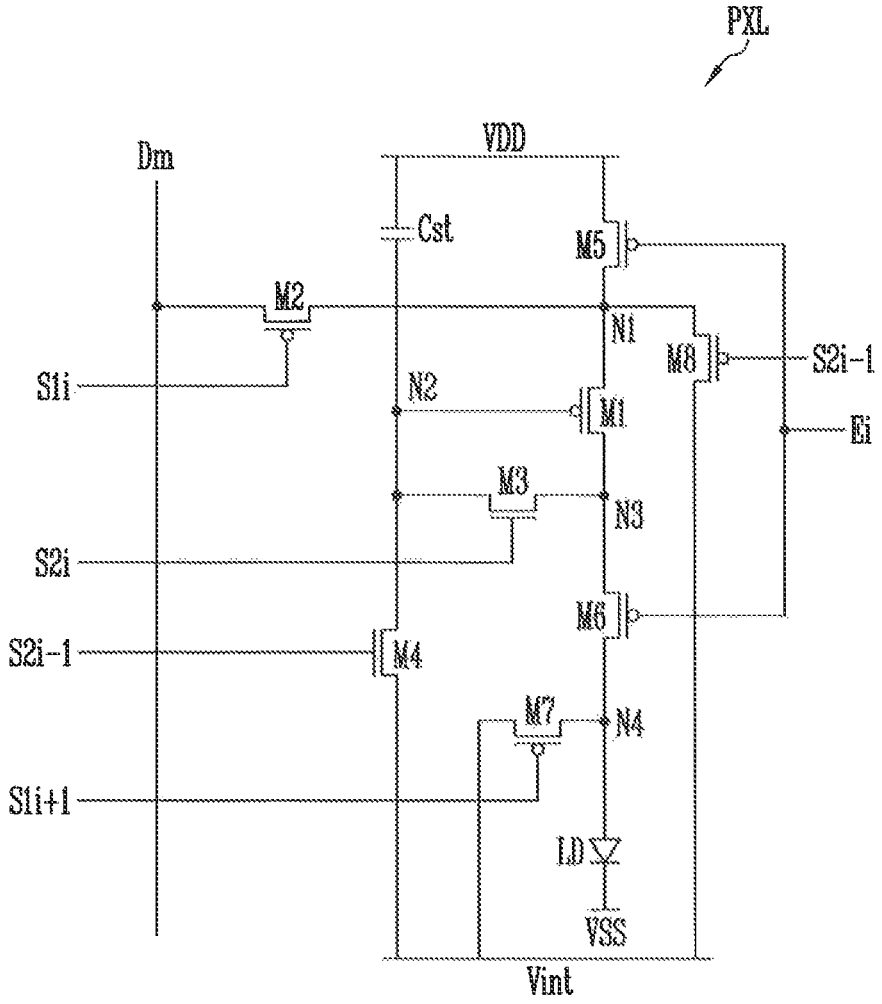
FIG. 7 is a circuit diagram illustrating a pixel included in the display device of FIG. 1, according to an exemplary embodiment of the present invention.

FIG. 7 is a circuit diagram illustrating a pixel PXL included in the display device 1000 of FIG. 1, according to an exemplary embodiment of the present invention.

In the following description of FIG. 7, the same reference numerals are used to designate the same or similar components as those of FIG. 2, and thus, a repetitive description thereof may be omitted.

Referring to FIG. 7, the pixel PXL may include a light emitting element LD, first to seventh transistors M1 to M7, and a storage capacitor Cst. In an exemplary embodiment of the present invention, the pixel PXL may further include an eighth transistor M8.

The light emitting element LD may emit light having a predetermined luminance corresponding to current supplied from the first transistor M1.

In an exemplary embodiment of the present invention, the driving method according to FIGS. 3A and 3B may be applied to the pixel PXL of FIG. 7.

In an exemplary embodiment of the present invention, the fourth transistor M4 and the seventh transistor M7 may be coupled to an identical initialization power supply Vint.

In an exemplary embodiment of the present invention, the eighth transistor T8 may be coupled between a first node N1 and the initialization power supply Vint. A gate electrode of the eighth transistor M8 is coupled to the i−1-th second scan line S2$i$−1. In other words, the gate electrode of the fourth transistor M4 and the gate electrode of the eighth transistor M8 are coupled in common to the i−1-th second scan line S2$i$−1.

When a scan signal is supplied to the i−1-th second scan line S2$i$−1, the eighth transistor M8 is turned on so that the voltage of the initialization power supply Vint may be supplied to the first node N1.

Hence, during the first period P1, the eighth transistor M8 may be controlled simultaneously with the fourth transistor M4.

In an exemplary embodiment of the present invention, the eighth transistor M8 may remain turned off during the second period P2.

The voltage of a second node N2 may be initialized (e.g., an on-bias may be applied to the second node N2) by turning on the fourth transistor M4. The fourth transistor M4 may be turned on by the same signal used to turn on the eighth transistor M8. As described above, if an excessively high on-bias is applied to the first transistor to M1, a variation in hysteresis of the first transistor M1 is increased in the low-frequency driving mode including the second period P2 that is a relatively long time. Therefore, to mitigate such hysteresis, the eighth transistor M8 may be added without having to remove the initialization power supply Vint.

The voltage of the initialization power supply Vint is simultaneously supplied to the first node N1 and the second node N2 by turning on the fourth transistor M4 and the eighth transistor M8. Thus, when the fourth and eighth transistors M4 and M8 are turned on, the first transistor M1 has a relatively low gate-source voltage, and the magnitude of a bias to be applied to the first transistor M1 is reduced. Therefore, a variation in characteristics of the first transistor M1 due to initialization of the gate voltage of the first transistor M1 may be minimized.

Therefore, a flicker phenomenon in the low-frequency driving mode in which the length of the second period P2 is increased in each frame period 1F may be mitigated. Furthermore, there is no need to separate the initialization power supply Vint for the fourth transistor M4 and the seventh transistor M7 into two parts, therefore production costs may be reduced.

Although FIG. 7 illustrates that each of the seventh and eighth transistors M7 and M8 is a P-type transistor, the present invention is not limited thereto. For example, at least one of the seventh transistor M7 and the eighth transistor M8 may be an N-type oxide semiconductor transistor.

Figure 8:
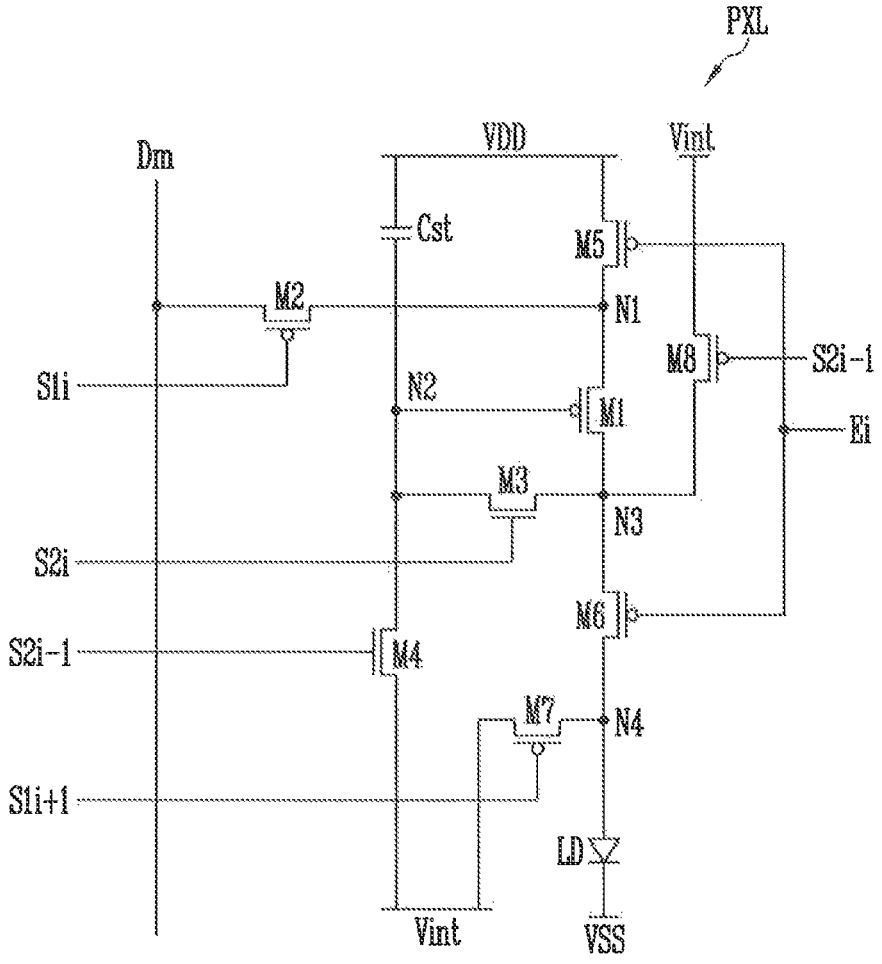
FIG. 8 is a circuit diagram illustrating a pixel included in the display device of FIG. 1, according to an exemplary embodiment of the present invention.

FIG. 8 is a circuit diagram illustrating a pixel PXL included in the display device of FIG. 1, according to an exemplary embodiment of the present invention.

In the following description of FIG. 8, the same reference numerals are used to designate the same or similar components as those of FIG. 7, and thus, a repetitive description thereof may be omitted.

Referring to FIG. 8, the pixel PXL may include a light emitting element LD, first to eighth transistors M1 to M8, and a storage capacitor Cst.

In an exemplary embodiment of the present invention, the eighth transistor M8 may be coupled between a third node N3 and an initialization power supply Vint. A gate electrode of the eighth transistor M8 is coupled to the i−1-th second scan line S2*i*-1. When a scan signal is supplied to the i−1-th second scan line S2*i*−1, the eighth transistor M8 is turned on so that the voltage of the initialization power supply Vint may be supplied to the third node N3. Hence, a voltage corresponding to the sum (Vint+Vth) of the voltage of the initialization power supply Vint and the threshold voltage may be supplied to a first node N1. In this case, the voltage of the initialization voltage Vint is supplied to the second node N2 by turning on the fourth transistor M4.

Therefore, when the first transistor M1 is initialized, a variation in bias of the first transistor M1 is reduced, therefore a variation in characteristics of the first transistor M1 may be minimized.

Therefore, a flicker phenomenon in the above-mentioned low-frequency driving mode may be mitigated. Furthermore, there is no need to separate the initialization power supply Vint for the fourth transistor M4 and the seventh transistor M7 into two parts, so that the production cost may be reduced.

Although FIG. 8 illustrates that each of the seventh and eighth transistors M7 and M8 is a P-type transistor, the present invention is not limited thereto. For example, at least one of the seventh transistor M7 and the eighth transistor M8 may be an N-type oxide semiconductor transistor.

Figure 9:
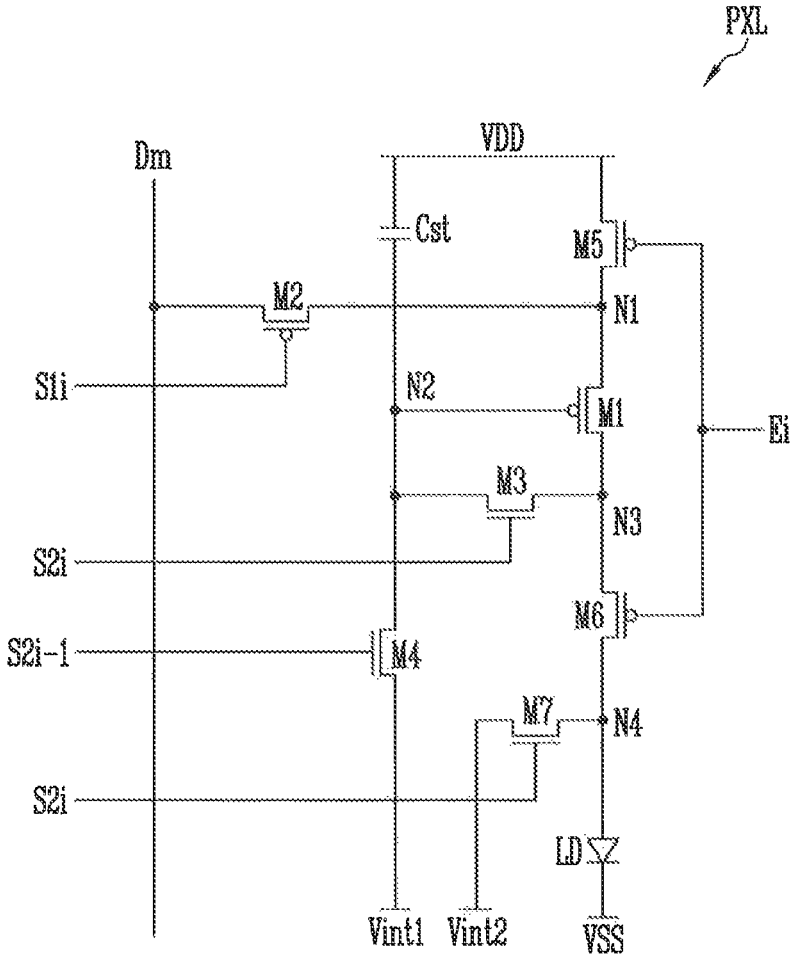
FIG. 9 is a circuit diagram illustrating a pixel included in the display device of FIG. 1, according to an exemplary embodiment of the present invention.
Figure 10A:
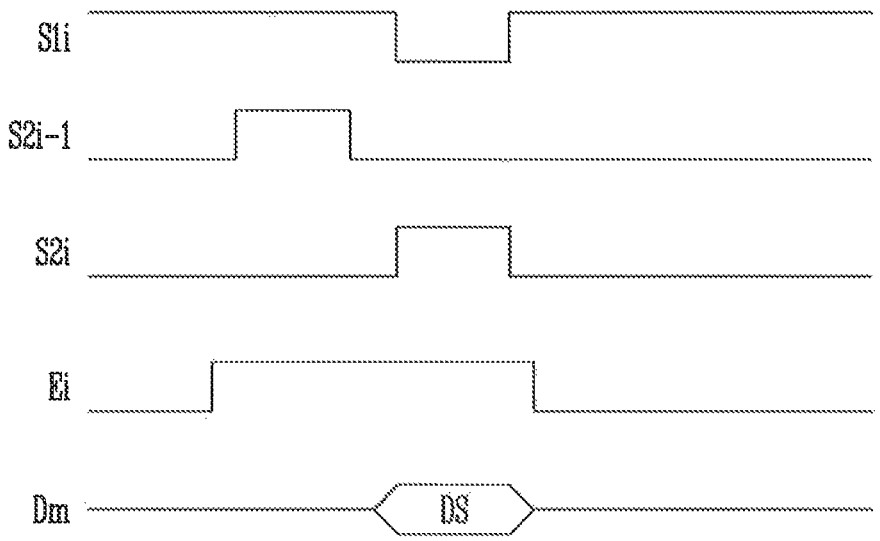
FIG. 10A is a timing diagram illustrating an operation of the pixel of FIG. 9, according to an exemplary embodiment of the present invention.
Figure 10B:
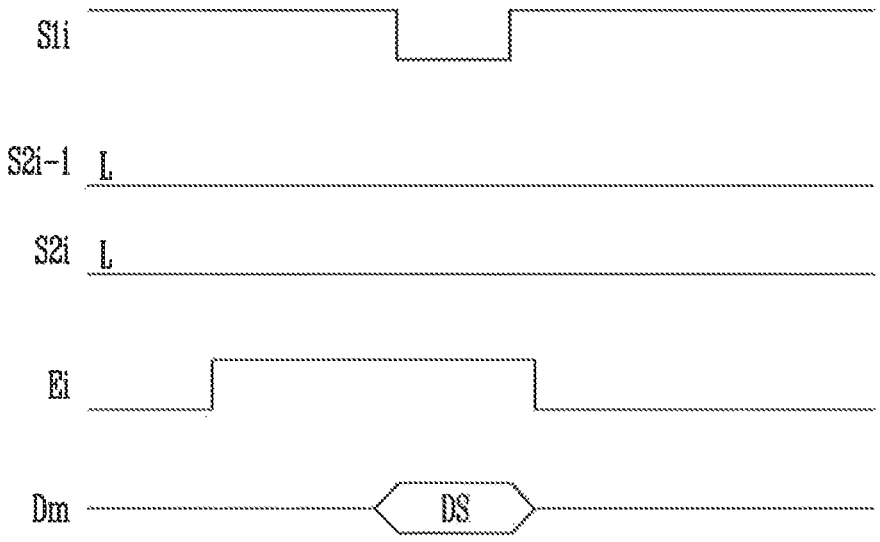
FIG. 10B is a timing diagram illustrating an operation of the pixel of FIG. 9, according to an exemplary embodiment of the present invention.

FIG. 9 is a circuit diagram illustrating a pixel PXL included in the display device 1000 of FIG. 1 according to an exemplary embodiment of the present invention, FIG. 10A is a timing diagram illustrating an operation of the pixel PXL of FIG. 9 according to an exemplary embodiment of the present invention, and FIG. 10B is a timing diagram illustrating an operation of the pixel PXL of FIG. 9 according to an exemplary embodiment of the present invention.

In the following description of FIG. 9, the same reference numerals are used to designate the same or similar components as those of FIG. 2, and thus, a repetitive description thereof may be omitted.

Referring to FIG. 9, the pixel PXL may include a light emitting element LD, first to seventh transistors M1 to M7, and a storage capacitor Cst.

In an exemplary embodiment of the present invention, each of the third transistor M3, the fourth transistor M4, and the seventh transistor M7 is an N-type transistor. For example, each of the third transistor M3, the fourth transistor M4, and the seventh transistor M7 may be an N-type oxide semiconductor transistor.

Since the seventh transistor M7 is an oxide semiconductor transistor, leakage current from a fourth node N4 may be minimized, therefore the display quality of the display device 1000 may be enhanced.

In an exemplary embodiment of the present invention, a gate electrode of the seventh transistor M7 may be coupled to the i-th second scan line S2*i*. Therefore, the third transistor M3 and the seventh transistor M7 may be simultaneously turned on. Furthermore, as illustrated in FIGS. 10A and 10B, the width of an emission control signal to be supplied to the i-th emission control line Ei may be reduced.

However, this is only for illustrative purposes, and the gate electrode of the seventh transistor M7 may be coupled to the i−1-th second scan line S2*i*−1 or the i+1-th second scan line S2*i*+1.

A method of operating the pixel PXL is substantially the same as that of the pixel PXL of FIG. 2. The main difference is that the gate electrode of the seventh transistor M7 is coupled to the second scan line S2*i* and a point in time at which the seventh transistor M7 is turned on differs from that of the pixel PXL of FIG. 2. Therefore, a repetitive description thereof will be omitted.

Figure 11:
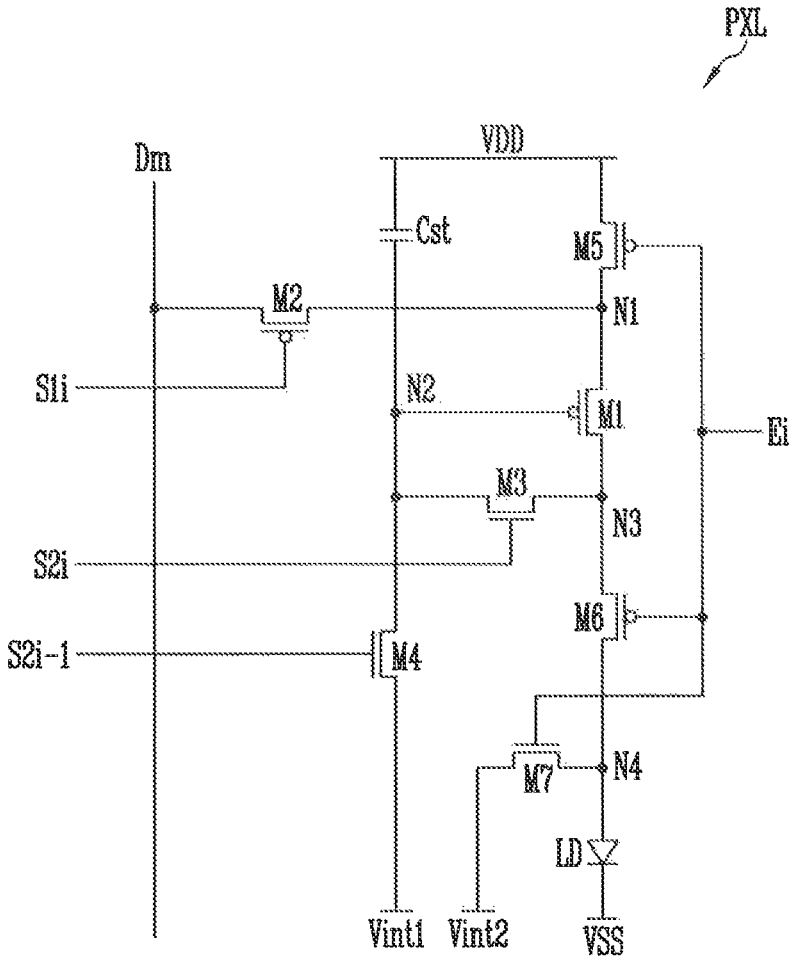
FIG. 11 is a circuit diagram illustrating a pixel included in the display device of FIG. 1, according to an exemplary embodiment of the present invention.
Figure 12:
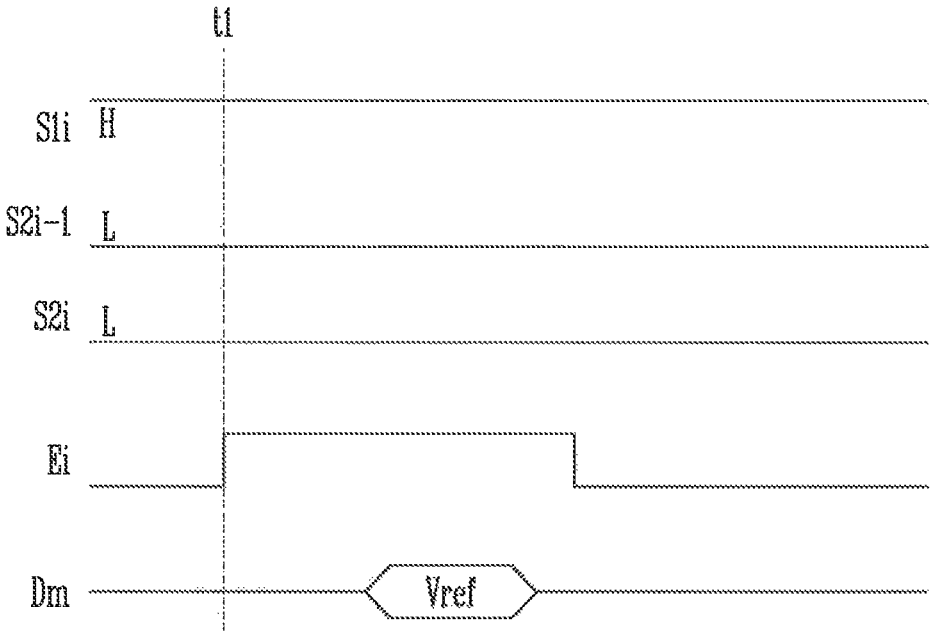
FIG. 12 is a timing diagram illustrating an operation of the pixel of FIG. 11, according to an exemplary embodiment of the present invention.

FIG. 11 is a circuit diagram illustrating a pixel PXL included in the display device 1000 of FIG. 1, and FIG. 12 is a timing diagram illustrating an operation of the pixel PXL of FIG. 11, according to an exemplary embodiment of the present invention.

In the following description of FIG. 11, the same reference numerals are used to designate the same or similar components as those of FIG. 2, and thus, a repetitive description thereof may be omitted.

The pixel PXL may include a light emitting element LD, first to seventh transistors M1 to M7, and a storage capacitor Cst.

The light emitting element LD may emit light having a predetermined luminance corresponding to current supplied from the first transistor M1.

In an exemplary embodiment of the present invention, each of the third, fourth, and seventh transistors M3, M4, and M7 is an N-type transistor. For example, each of the third transistor M3, the fourth transistor M4, and the seventh transistor M7 may be an N-type oxide semiconductor transistor.

Each of the first, second, fifth, and sixth transistors M1, M2, M5, and M6 is a P-type transistor. For example, each of the first, second, fifth, and sixth transistors M1, M2, M5, and M6 may be a P-type LTPS transistor.

The seventh transistor M7 is coupled between a second initialization power supply Vint2 and a fourth node N4. In an exemplary embodiment of the present invention, a gate electrode of the seventh transistor M7 may be coupled to the i-th emission control line Ei. The seventh transistor M7 may be turned on when an emission control signal is supplied to the emission control line Ei, and may be turned off in the other cases. In other words, the seventh transistor M7 that is an N-type transistor may be turned on or off contrary to the fifth and sixth transistors M5 and M6. For example, when the seventh transistor M7 is on, the fifth and sixth transistors M5 and M6 are off.

When an emission control signal is supplied, the seventh transistor M7 is turned on so that the voltage of the second initialization power supply Vint2 may be supplied to the first electrode of the light emitting element LD.

Signals to be supplied to the pixel PXL during the first period P1 (e.g., the display scan period T1) are substantially the same as those of the driving method described with reference to FIG. 10A; therefore, a repetitive description thereof will be omitted.

In an exemplary embodiment of the present invention, as illustrated in FIG. 12, only an emission control signal may be supplied to the pixel PXL through the i-th emission control line Ei during the second period P2 (e.g., the self-scan period T2). During the second period P2, a scan signal is supplied to neither the first scan line S1 nor the second scan line S2. In other words, a gate off voltage having a logic high level H may be supplied to the first scan line S1 (e.g., S1*i*). A gate off voltage having a logic low level L may be supplied to the second scan line S2 (e.g., S2*i*−1 and S2*i*).

At a first time t at which all of the second to fourth transistors M2 to M4 are turned off, the emission control signal supplied to the i-th emission control line Ei is transitions from a logic low level to a logic high level. Therefore, the fifth transistor M5 and the sixth transistor M6 are turned off. In this case, since the gate voltage of the fifth transistor M5 is increased, e.g., by a parasitic capacitor between the gate electrode of the fifth transistor M5 and the first node N1, the voltage of the first node N1 is coupled with the increased gate voltage of the fifth transistor M5. As a consequence, the voltage of the first node N1 may be increased. Therefore, an on-bias may be applied to the first transistor M1 at each first time t1 of the second period P2.

Therefore, there is no need to turn on the second transistor M2 to apply an on-bias during the second period P2, and the first scan driver 200 may not output a scan signal during the second period P2. Consequently, the power consumption may be reduced.

Figure 13:
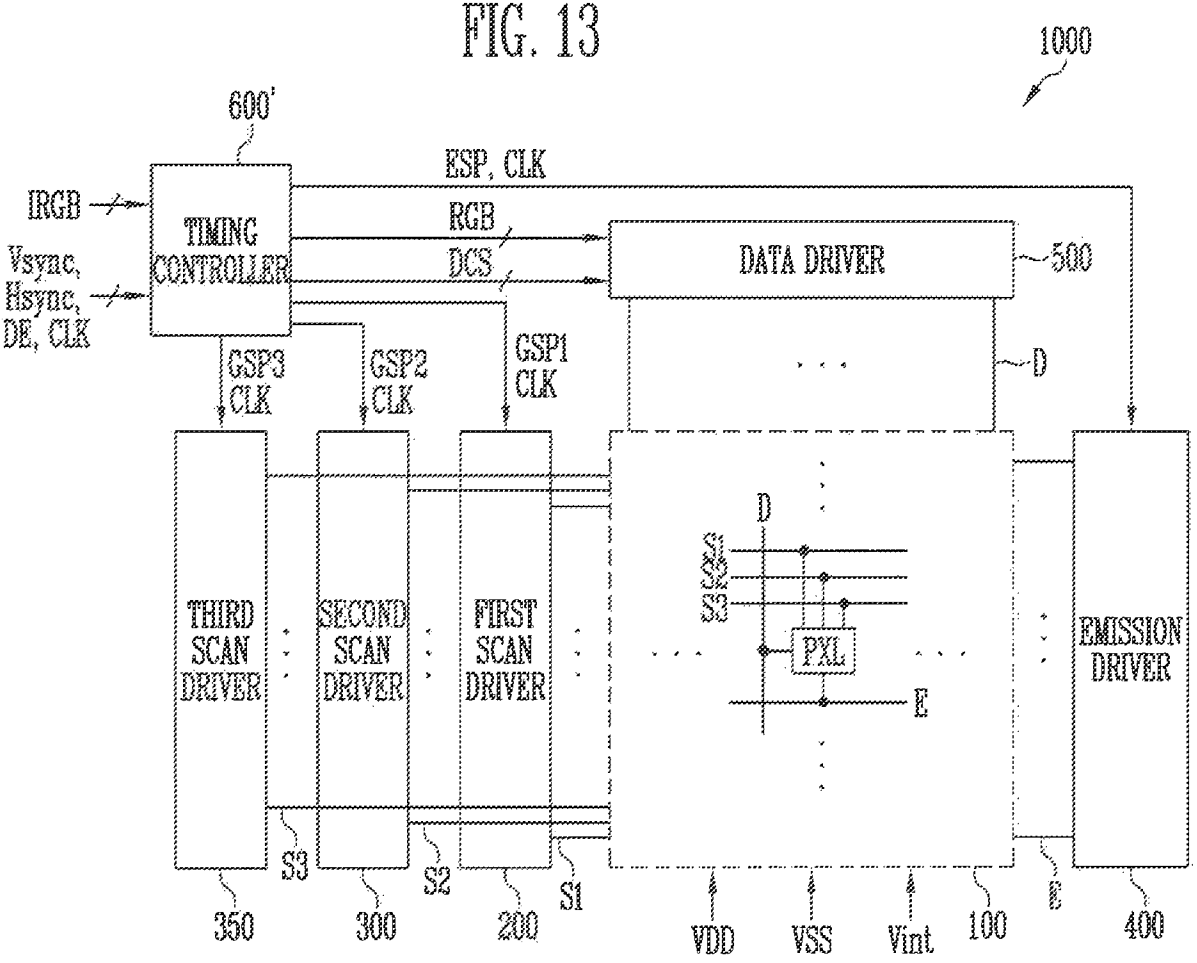
FIG. 13 is a block diagram illustrating a display device in accordance with exemplary embodiments of the present invention.

FIG. 13 is a block diagram illustrating a display device 1000 in accordance with exemplary embodiments of the present invention.

In the following description of FIG. 13, the same reference numerals are used to designate the same or similar components as those of FIG. 1, and thus, a repetitive description thereof may be omitted.

Referring to FIG. 13, the display device 1000 may include a pixel unit 100, a first scan driver 200, a second scan driver 300, a third scan driver 350, an emission driver 400, a data driver 500, and a timing controller 600'.

The timing controller 600' may supply gate start pulses GSP1, GSP2, and GSP3 and clock signals CLK to the first scan driver 200, the second scan driver 300, and the third scan driver 350 based on timing signals Vsync, Hsync, DE, and CLK.

The first gate start pulse GSP1 may control a first timing of a scan signal is to be supplied from the first scan driver 200. The second gate start pulse GSP2 may control a first timing of a scan signal to be supplied from the second scan driver 300.

The third gate start pulse GSP3 may control a first timing of a scan signal to be supplied from the third scan driver 350.

In an exemplary embodiment of the present invention, a pulse width of at least one of the first to third gate start pulses GSP1 to GSP3 may differ from that of the other. Therefore, the widths of their corresponding scan signals may also vary.

The data driver 500 may supply data signals to data lines D in response to a data driving control signal DCS. The data signals supplied to the data lines D may be supplied to pixels PXL selected by scan signals.

The first scan driver 200 may supply scan signals to the first scan lines S in response to the first gate start pulse GSP1. The first scan driver 200 may supply scan signals to the first scan lines S1 at a first frequency regardless of a driving frequency of the display device 1000. In other words, the first scan driver 200 may output scan signals during a first period P1 and a second period P2. Particularly, the first scan driver 200 may output scan signals during each self-scan period T2.

The second scan driver 300 may supply scan signals to the second scan lines S2 in response to the second gate start pulse GSP2. The second scan driver 300 may supply scan signals to the second scan lines S2 at a second frequency corresponding to the driving frequency of the display device 1000. In other words, the second scan driver 300 may output scan signals during the first period P1.

The third scan driver 350 may supply scan signals to the third scan lines S3 in response to the third gate start pulse GSP3. The third scan driver 350 may supply is scan signals to the third scan lines S3 at a second frequency corresponding to the driving frequency of the display device 1000. In other words, the third scan driver 350 may output scan signals during the first period P1. In an exemplary embodiment of the present invention, the width of a scan signal output from the third scan driver 350 may differ from the width of a scan signal output from the second scan driver 300.

In an exemplary embodiment of the present invention, a scan signal output from the first scan driver 200 may have a gate-on voltage having a logic low level to control a P-type transistor. Each of scan signals output from the second and third scan drivers 300 and 350 may have a gate-on voltage having a logic high level to control an N-type transistor.

The pixels PXL may be coupled to one or more first scan lines S1, one or more second scan lines S2, one or more third scan lines S3, and one or more emission control lines E depending on the structure of a pixel circuit.

Figure 14:
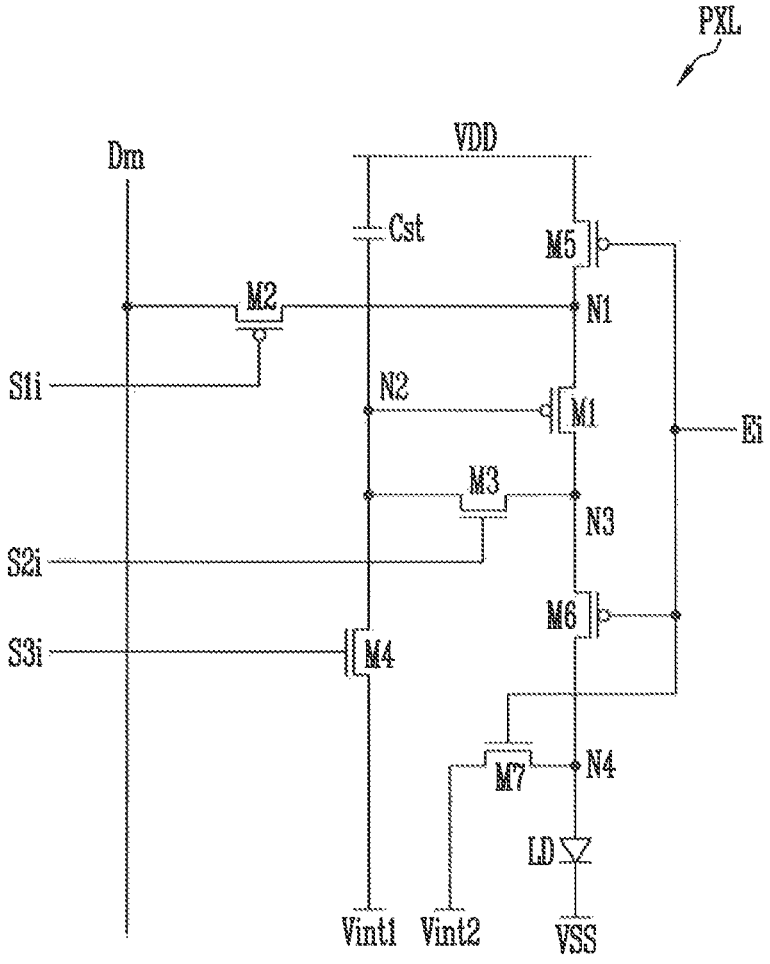
FIG. 14 is a circuit diagram illustrating a pixel included in the display device of FIG. 13, according to an exemplary embodiment of the present invention.
Figure 15A:
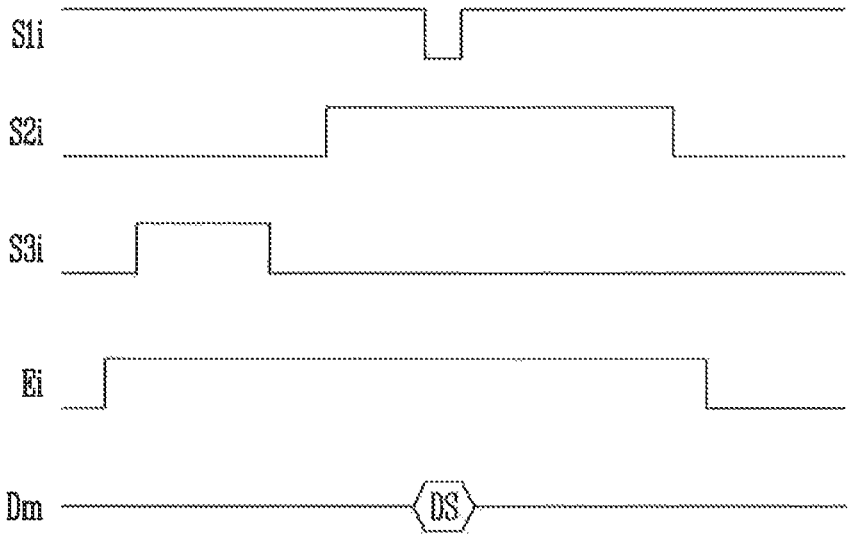
FIGS. 15A, 15B and 15C are timing diagrams illustrating of the operation of the pixel of FIG. 14, according to exemplary embodiments of the present invention.
Figure 15B:
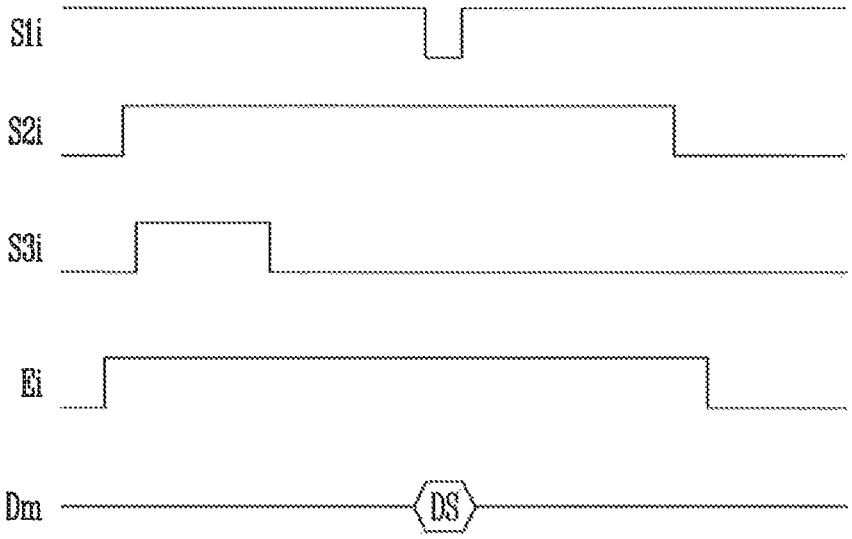
Figure 15C:
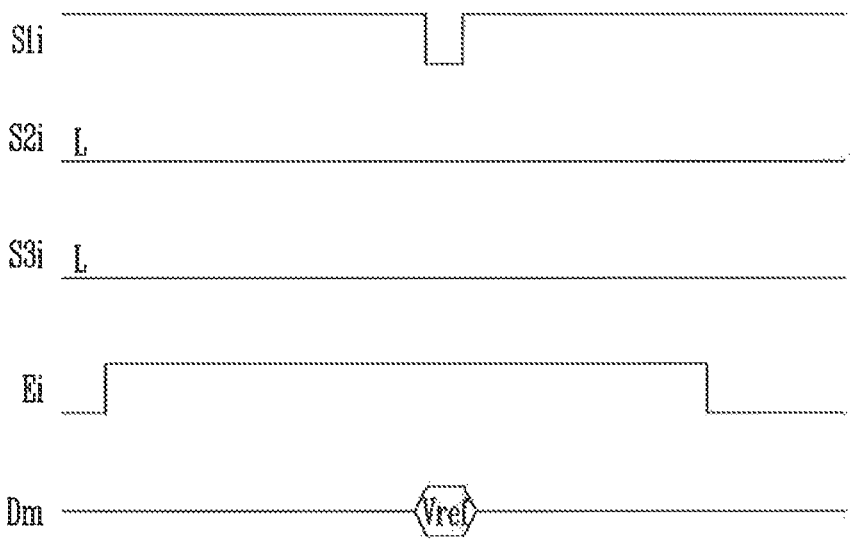

FIG. 14 is a circuit diagram illustrating a pixel PXL included in the display device 1000 of FIG. 13 according to an exemplary embodiment of the present invention, and FIGS. 15A to 15C are timing diagrams illustrating an operation of the pixel PXL of FIG. 14 according to exemplary embodiments of the present invention.

In FIG. 14, for the sake of description, there is illustrated a pixel PXL that to is disposed on an i-th horizontal line and coupled with an m-th data line Dm.

In the following description of FIG. 14, the same reference numerals are used to designate the same or similar components as those of FIG. 11, and thus, a repetitive description thereof may be omitted.

Referring to FIGS. 14 to 15C, the pixel PXL may include a light emitting is element LD, first to seventh transistors M1 to M7, and a storage capacitor Cst.

The light emitting element LD may emit light having a predetermined luminance corresponding to current supplied from the first transistor M1.

In an exemplary embodiment of the present invention, each of the third, fourth, and seventh transistors M3, M4, and M7 is an N-type transistor. For example, each of the third transistor M3, the fourth transistor M4, and the seventh transistor M7 may be an N-type oxide semiconductor transistor.

Each of the first, second, fifth, and sixth transistors M1, M2, M5, and M6 is a P-type transistor. For example, each of the first, second, fifth, and sixth transistors M1, M2, M5, and M6 may a P-type LTPS transistor.

In an exemplary embodiment of the present invention, a gate electrode of the fourth transistor M4 may be coupled to an i-th third scan line S3*i*. Therefore, in the case where the width of a scan signal supplied to the third scan line S3 differs from that of a scan signal supplied to the second scan line S2, a turn-on time of the third transistor M3 and a turn-on time of the fourth transistor M4 may differ from each other.

First, an emission control signal is supplied to the emission control line Fi. If the emission control signal is supplied to the emission control line Ei, the fifth and sixth transistors M5 and M6 are turned off, and the seventh transistor M7 is turned on. If the fifth and sixth transistors M5 and M6 are turned off, the pixel PXL is set to a non-emission state. A second initialization power supply Vint2 is supplied to a fourth node N4 by turning on the seventh transistor M7.

In an exemplary embodiment of the present invention, as illustrated in FIGS. 15A and 15B, a scan signal supplied to the third scan line S3*i* may be supplied earlier than a scan signal supplied to the first scan line S1*i* or a scan signal supplied to the second scan line S2*i*. Therefore, the fourth transistor M4 may be turned on by the scan signal supplied to the third scan line S3*i*. If the fourth transistor M4 is turned on, the first initialization power supply Vint1 is supplied to a second node N2. In this case, the first transistor M1 has an on-bias state.

Subsequently, the third transistor M3 may be turned on by the scan signal supplied to the second scan line S2*i*. Hence, the first transistor M1 may be coupled in the form of a diode.

As illustrated in FIG. 15A, in an exemplary embodiment of the present invention, the scan signal supplied to the second scan line S2*i* may overlap with the scan signal supplied to the first scan line S1*i*. Furthermore, the width of the scan signal supplied to the second scan line S2*i* may be greater than the width of the scan signal supplied to the first scan line S1*i*.

Thereafter, while the third transistor M3 is in a turned-on state, the second transistor M2 is turned on by the scan signal supplied to the first scan line S1*i*. If the second transistor M2 is turned on, a voltage of a data signal is supplied to the first transistor M1 through a first node N1, and the state of the first transistor M1 may be changed to an off-bias state in which the voltage of the second node N2 is lower than the voltage of the first node N1. Furthermore, a data signal DS and a voltage corresponding to the threshold voltage of the first transistor M1 may be applied to the first node N1 by the first transistor M1 connected in the form of a diode. In this case, the storage capacitor Cst may store a voltage corresponding to the second node N2.

Subsequently, the second transistor M2 and the third transistor M3 are is sequentially turned off.

Thereafter, the supply of the emission control signal to the emission control line Ei may be suspended. If the supply of the emission control signal to the emission control line Ei is suspended, the fifth and sixth transistors M5 and M6 are turned on, and the seventh transistor M7 is turned off. In this case, the first transistor M1 may control a driving current flowing to the light emitting element LD in response to the voltage of the second node N2. The light emitting element LD may generate light having a luminance corresponding to the amount of current provided thereto.

In an exemplary embodiment of the present invention, each of the scan signals supplied to the second scan line S2*i* and the third scan line S3*i* may have a width corresponding to two or more horizontal periods (2H). Each of the second scan driver 300 and the third scan driver 350 may include a plurality of stages configured to shift and output scan signals.

In the case where the scan signal to be supplied to the second scan line S2*i* has a width corresponding to two or more horizontal periods (2H), the output of each stage included in the second scan driver 300 may share two or more consecutive second scan lines S2. In other words, an identical scan signal may be supplied from the second scan driver 300 to an i-th horizontal line and an i+1-th horizontal line at the same time.

For example, in the case where each stage of the second scan driver 300 shares two second scan lines S2, the number of stages included in the second scan driver 300 may be reduced to half of the number of stages included in the first scan driver 200. Therefore, the production cost of the display device 1000 may be reduced.

In an exemplary embodiment of the present invention, as illustrated in FIG. 15B, a scan signal supplied to the second scan line S2*i* may overlap with a scan signal supplied to the first scan line S1*i* and a scan signal to be supplied to the third scan line S3*i*. In other words, the width of the scan signal supplied to the second scan line S2*i* may be greater than the width of the scan signal supplied to the first scan line S1*i* or the third scan line S3*i*.

After an emission control signal has been supplied to the emission control line Ei, scan signals are supplied to the second and third scan lines S2*i* and S3*i*. Hence, the third and fourth transistors M3 and M4 are turned on. If the third and fourth transistors M3 and M4 are turned on, the first initialization voltage Vint1 is supplied to the second and third nodes N2 and N3. Furthermore, if the third and fourth transistors M3 and M4 are turned on, the first node N1 has a voltage corresponding to the sum (Vint+Vth) of the first initialization voltage Vint1 and the threshold voltage of the first transistor M1 by virtue of the first transistor M1 being connected in the form of a diode. Therefore, the first transistor M1 has an off-bias state.

Thereafter, the fourth transistor M4 is turned off, and the second transistor M2 is turned on by the scan signal supplied to the first scan line S1. A subsequent driving method is substantially the same as the driving method of FIG. 15A; therefore, a further explanation thereof will be omitted.

As illustrated in FIG. 15C, an emission control signal is supplied to the emission control line Ei during a self-scan period T2 included in the second period P2. Hence, the light emitting element LD is periodically initialized during the second period P2. Furthermore, a scan signal is supplied to the first scan line S1*i* during the self-scan period T2. Therefore, a predetermined voltage is periodically applied to a first electrode (e.g., a source electrode) of the first transistor M1 during the second period P2.

A driving method of the embodiment of FIG. 15C is substantially the same as the driving method described with reference to FIG. 3B, etc., therefore; a further explanation thereof will be omitted.

In the method of driving the pixel PXL described with reference to FIGS. 14 to 15B, an off-bias is applied to the first transistor M1 during the first period P1, and an on-bias is periodically applied to the first transistor M1 during the second period P2. Therefore, a flicker phenomenon due to hysteresis of the first transistor M1 in a low-frequency driving mode may be minimized.

The driving method of the pixel PXL described with reference to FIGS. 15A to 15C may also be applied to the pixel PXL described with reference to FIGS. 2, 9, 11, etc. in substantially the same manner.

Figure 16:
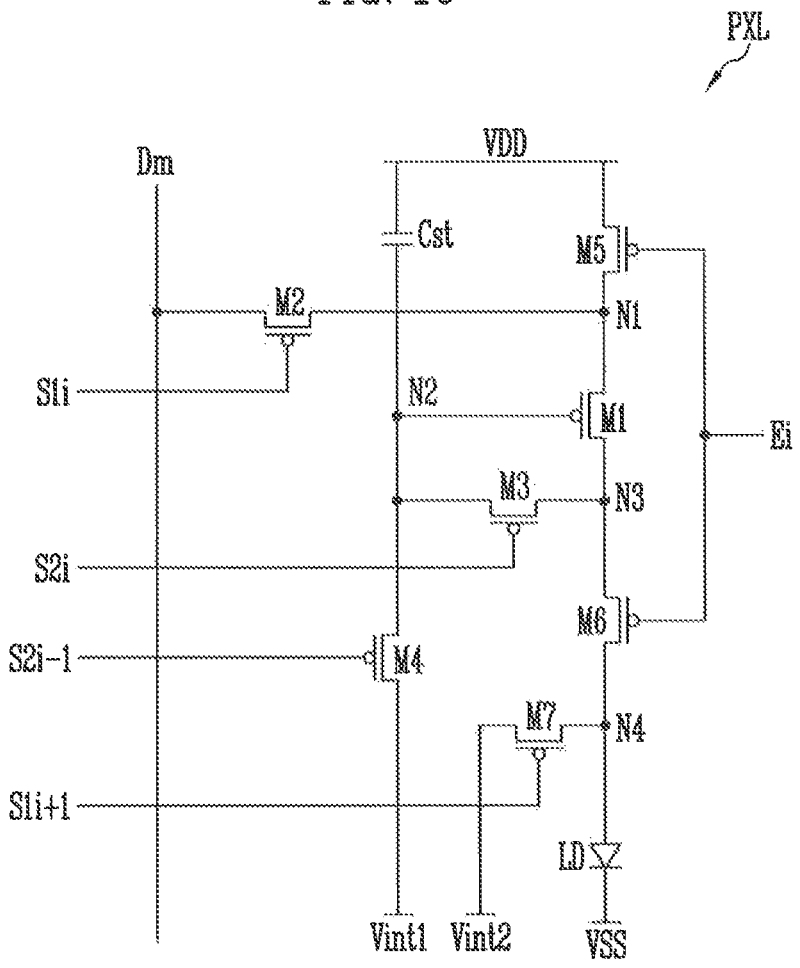
FIG. 16 is a circuit diagram illustrating a pixel included in the display device of FIG. 1, according to an exemplary embodiment of the present invention.
Figure 17A:
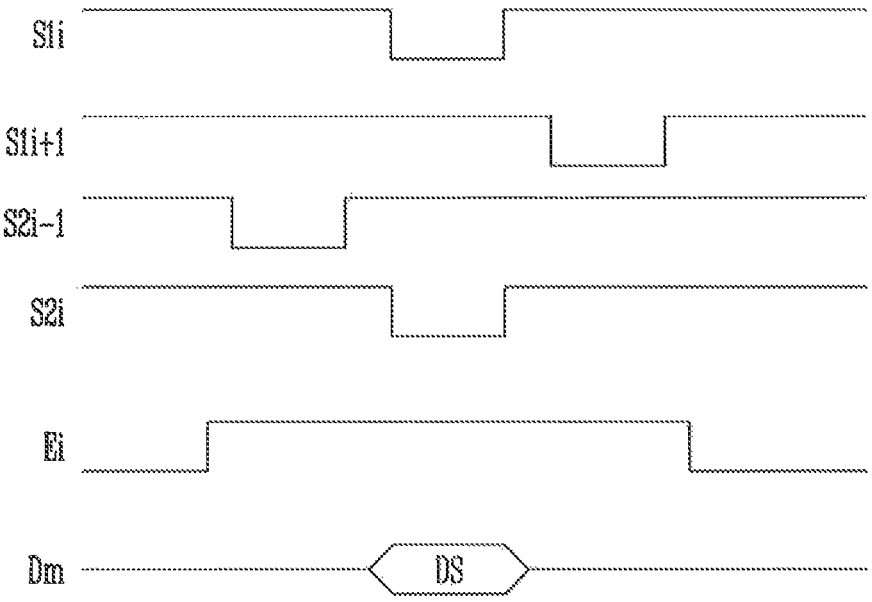
FIGS. 17A and 17B are timing diagrams illustrating an operation of the pixel of FIG. 16, according to exemplary embodiments of the present invention.
Figure 17B:
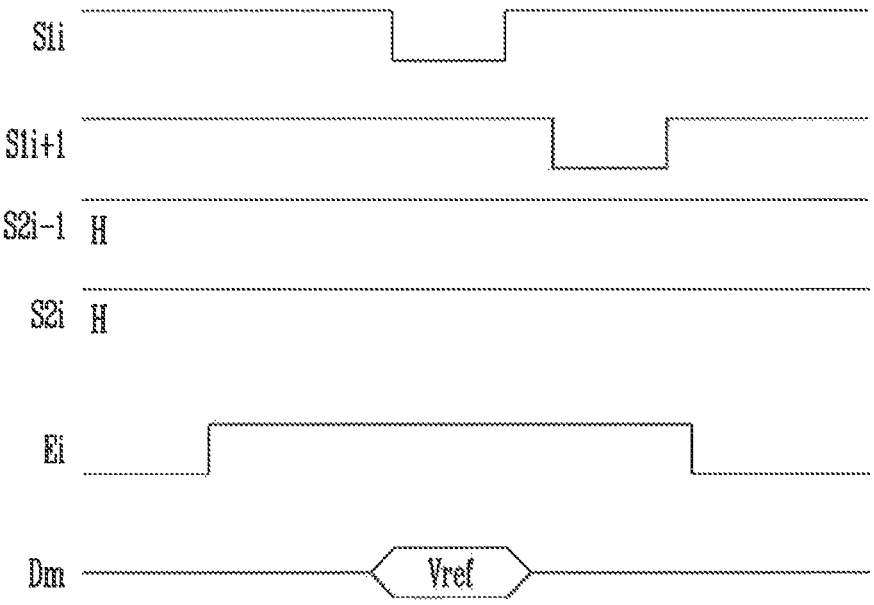

FIG. 16 is a circuit diagram illustrating a pixel PXL included in the display device 1000 of FIG. 1, and FIGS. 17A and 17B are timing diagrams illustrating an operation of the pixel PXL of FIG. 16, according to an exemplary embodiment of the present invention.

In the following description of FIGS. 16 to 17B, the same reference numerals are used to designate the same or similar components as those of FIGS. 2 to 3B, and thus, a repetitive description thereof may be omitted.

Referring to FIGS. 16 to 17B, the pixel PXL may include a light emitting element LD, first to seventh transistors M1 to M7, and a storage capacitor Cst.

In an exemplary embodiment of the present invention, each of the first to seventh transistors M1 to M7 is a poly-silicon semiconductor transistor. For example, each of the first to seventh transistors M1 to M7 may be a P-type LTPS transistor. Hence, each of scan signals to be supplied to the first to seventh transistors M1 to M7 has a gate-on voltage having a logic low level.

A driving method illustrated in FIG. 17A pertains to an operation of the pixel PXL during the first period P2 (e.g., the display scan period T1). A driving method illustrated in FIG. 17B pertains to an operation of the pixel PXL during the self-scan period T2 of the second period P2. The driving methods of FIGS. 17A and 17B are substantially the same as the driving method of FIGS. 3A and 3B; therefore, a repetitive description thereof will be omitted. The main difference is that in the methods of FIGS. 17A and 17B, a scan signal has a gate-on voltage having a logic low level.

Figure 18:
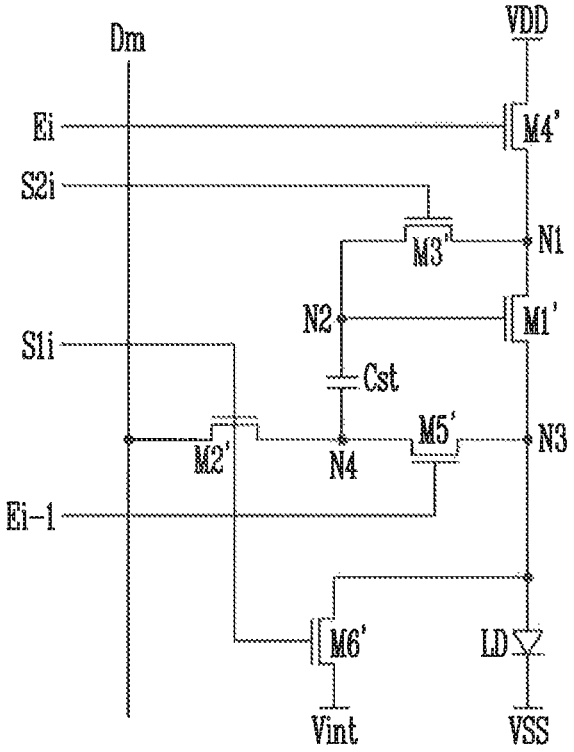
FIG. 18 is a circuit diagram illustrating a pixel included in the display device of FIG. 1, according to an exemplary embodiment of the present invention.
Figure 19A:
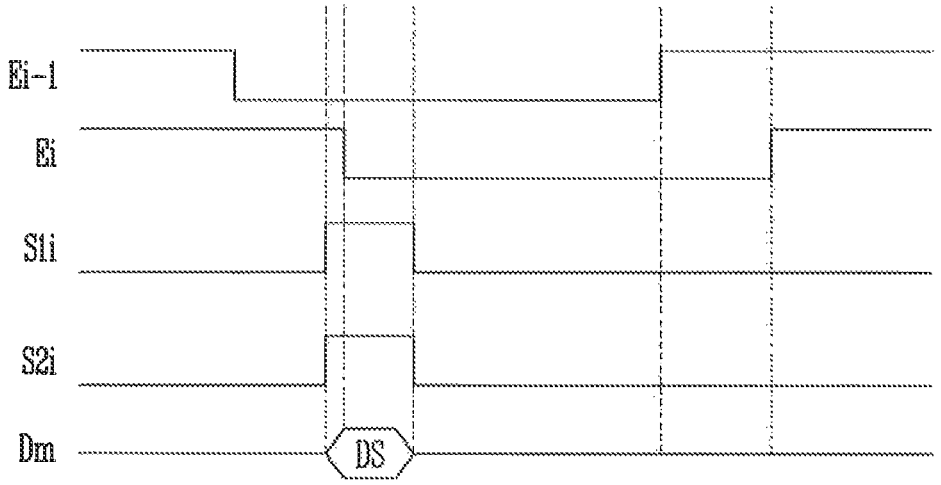
FIGS. 19A and 19B are timing diagrams illustrating an operation of the pixel of FIG. 18, according to exemplary embodiments of the present invention.
Figure 19B:
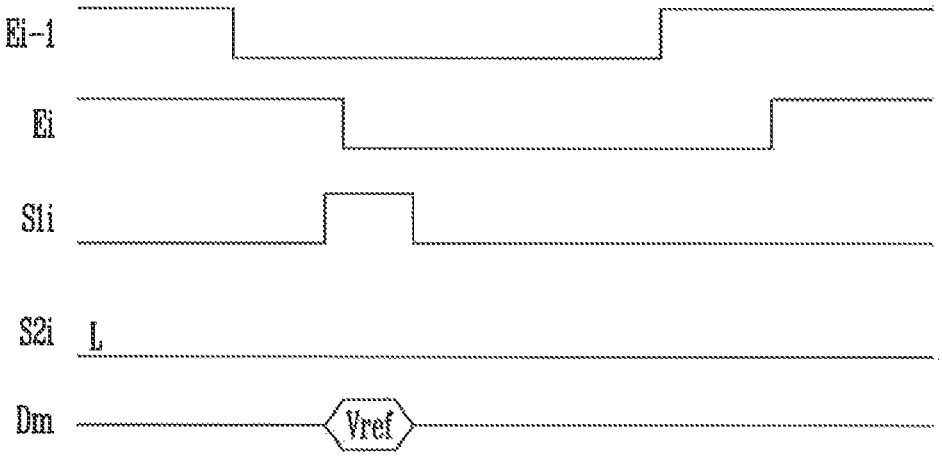

FIG. 18 is a circuit diagram illustrating a pixel PXL included in the display device 1000 of FIG. 1 according to an exemplary embodiment of the present invention, and FIGS. 19A and 19B are timing diagrams illustrating an operation of the pixel PXL of FIG. 18 according to an exemplary embodiment of the present invention.

Referring to FIGS. 18 to 19B, the pixel PXL may include a light emitting element LD, first to sixth transistors M1' to M6', and a storage capacitor Cst.

The first to sixth transistors M1' and M6' each may be an oxide semiconductor transistor. For example, the first to sixth transistors M1' and M6' each may be an N-type oxide semiconductor transistor.

The light emitting element LD may emit light having a predetermined luminance corresponding to current supplied from the first transistor M1.

The first transistor M1'(or the driving transistor) is connected between a first node N1 and a third node N3. A gate electrode of the first transistor M1 is coupled is to a second node N2. The first transistor M1 may control, in response to the voltage of the second node N2, the amount of current flowing from the first power supply VDD to the second power supply VSS via the light emitting element LD.

The second transistor M2' may be coupled between a data line Dm and a fourth node N4. A gate electrode of the second transistor M2' may be coupled to an i-th first scan line S1*i*. When a scan signal is supplied to the i-th first scan line S1*i*, the second transistor M2' may be turned on to electrically couple the data line Dm with the fourth node N4.

The third transistor M3' is coupled between the first node N1 and the second node N2. A gate electrode of the third transistor M3' may be coupled to an i-th second scan line S2*i*.

The fourth transistor M4' is coupled between the first power supply VDD and the first node N1. A gate electrode of the fourth transistor M4' is coupled to an i-th emission control line Ei. The fourth transistor M4' may be turned off when an emission control signal is supplied to the i-th emission control line Ei, and may be turned on in the other cases.

The fifth transistor M5' is coupled between the third node N3 and the fourth node N4. A gate electrode of the fifth transistor M5' may be coupled to an i−1-th emission control line Ei−1. The fifth transistor M5' may be turned off when an emission control signal is supplied to the i−1-th emission control line Ei−1, and may be turned on in the other cases.

The sixth transistor M6' may be coupled between the third node N3 and an initialization power supply Vint. A gate electrode of the sixth transistor M6' may be coupled to the i-th first scan line S1*i*.

The storage capacitor Cst may be coupled between the second node N2 and the fourth node N4. The storage capacitor Cst may store a voltage applied to the fourth node N4.

FIG. 19A illustrates an example of a driving method during the first period P1.

First, an emission control signal is supplied to the i−1-th emission control line Ei−1, and the fifth transistor M5' is turned off. In this case, since the sixth transistor M6' is in a turned-on state, the first power supply VDD is supplied to the first node N1.

Thereafter, scan signals are supplied to the first scan line S1*i* and the second scan line S2*i*, and the second, third, and sixth transistors M2', M3', and M6' are turned on.

If the second transistor M2' is turned on, a data signal DS is supplied to the fourth node N4. If the third transistor M3' is turned on, the voltage of the first power supply VDD is supplied to the second node N2. Hence, the first transistor M1' may have an off-bias state. If the sixth transistor M6' is turned on, the voltage of the initialization power supply Vint is supplied to the third node N3 (e.g., the first electrode of the light emitting element LD).

Subsequently, while the scan signals are supplied to the first scan line S1*i* and the second scan line S2*i*, an emission control signal is supplied to the i-th emission control line Ei. Therefore, while the second, third, and sixth transistors M2', M3', and M6' remain turned on, the fourth transistor M4' is turned off.

If the fourth transistor M4' is turned off, the first transistor M1' enters a source follower state. Therefore, the first node N1 and the second node N2 may have a voltage corresponding to the sum (Vint+Vth) of the voltage of the initialization power supply Vint and the threshold voltage of the first transistor M1'. In other words, the threshold voltage of the first transistor M1' may be compensated for.

Thereafter, the supply of the scan signals to the first scan line S1*i* and the second scan line S2*i* is suspended, and the second, third, and sixth transistors M2', M3', and M6' are turned off.

Subsequently, the supply of the emission control signal to the i−1-th emission control line Ei−1 is suspended, and the fifth transistor M5' is turned on. If the fifth transistor M5' is turned on, the voltage of the initialization power supply Vint of the third node N3 is transmitted to the fourth node N4. The sum (DS+Vth) of the data signal DS and the threshold voltage of the first transistor M1' is transmitted to the second node N2 by coupling. A voltage corresponding to Vth+DS−Vint is stored in the storage capacitor Cst.

Subsequently, the supply of the emission control signal to the i-th emission control line Ei is suspended, and the fourth transistor M4' is turned on. Therefore, the pixel PXL may emit light based on the voltage corresponding to Vth+DS−Vint.

In the pixel PXL having the above-mentioned configuration, an operation of compensating for the threshold voltage of the first transistor M1' and a data write operation may be separated from each other. Accordingly, the time required for the threshold voltage compensation may be reliably secured.

FIG. 19B illustrates an example of a driving method during the self-scan period T2 of the second period P2.

A scan signal is not supplied to the second scan line S2*i* during the second period P2. Hence, the third transistor M3' is not turned on during the second period P2.

During the second period P2, a predetermined reference voltage Vref may be supplied to the fourth node N4 by turning on the second transistor M2', and the light emitting element LD may be initialized by turning on the sixth transistor M6'.

The scan signal to be supplied to the first scan line S1*i* and the emission control signals to be supplied to the emission control lines Ei−1 and Ei may be supplied at the first frequency regardless of the driving frequency. On the other hand, the scan signal to be supplied to the second scan line S2*i* may be supplied to the second scan line S2*i* at the second frequency corresponding to the driving frequency. In other words, as the pixel PXL of FIG. 18 is applied to the display device 1000 of FIG. 1, it is possible to support the output of images having various driving frequencies. For example, the driving frequency of the display device 1000 may correspond to submultiples of the first frequency.

In a display device in accordance with exemplary embodiments of the present invention, each frame period includes a display scan period and at least one self-scan period, so that the output of images having various driving frequencies can be supported. Furthermore, as a driving frequency is reduced, the number of self-scan periods is increased. Consequently, luminance reduction and high flicker visibility in a low-frequency driving mode may not occur or be mitigated.

Moreover, as a predetermined bias is periodically applied to a first transistor (e.g., a driving transistor), the power consumption may be reduced, and a is flicker phenomenon in the low-frequency driving mode may be mitigated.

While the present invention has been described in connection with exemplary embodiments thereof, it will be understood by those of skill in the art that various changes in form and details may be made thereto without departing from the spirit and scope of the present invention as set forth in the following claims.

What is claimed is:

1. A display device, comprising:

pixels coupled to first scan lines, second scan lines, emission control lines, and data lines;

a first scan driver configured to supply a first scan signal to each of the first scan lines at a first frequency;

a second scan driver configured to supply a second scan signal to each of the second scan lines at a second frequency corresponding to a driving frequency of the to pixels;

an emission driver configured to supply an emission control signal to each of the emission control lines at the first frequency;

a data driver configured to supply a data signal to each of the data lines at the second frequency; and is a timing controller configured to control the first scan driver, the second scan driver, the emission driver, and the data driver.

2. The display device according to claim 1, wherein the first frequency is greater than the second frequency.

3. The display device according to claim 1, wherein the second frequency is equal to the driving frequency and, wherein the second frequency and the driving frequency correspond to a submultiple of the first frequency.

4. The display device according to claim 1, wherein the first scan driver supplies the first scan signal to each of the first scan lines at the first frequency that is two times a maximum driving frequency of the display device.

5. The display device according to claim 4, wherein the emission driver supplies the emission control signal to each of the emission control lines at the first frequency that is two times the maximum driving frequency of the display device.

6. The display device according to claim 4, wherein, when driven at the driving frequency, the second scan driver supplies the second scan signal during a first period of a frame period, and wherein, when driven at the driving frequency, the second scan driver does not supply the second scan signal during a second period of the frame period.

7. The display device according to claim 6, wherein, when driven at the maximum driving frequency of the display device, a length of the first period is equal to a length of the second period.

8. The display device according to claim 6, wherein the first period includes a display scan period in which the first scan driver and the second scan driver supply the first and second scan signals so that the data signal is written to the pixels, and wherein the second period includes a self-scan period in which characteristics of a driving transistor included in each of the pixels is changed by the supply of the first scan signal from the first scan driver.

9. The display device according to claim 8, wherein, when the driving frequency is reduced, the number of self-scan periods included in the second period is increased.

10. The display device according to claim 1, wherein a pixel disposed on an i-th (i is a natural number) horizontal line of the pixels comprises;

a light emitting element including a first electrode, and a second electrode coupled to a second power supply;

a first transistor including a first electrode coupled to a first node electrically connected to a first power supply, and configured to control a driving current based on a voltage of a second node;

a second transistor coupled between a data line of the data lines and the first node, and configured to be turned on by the first scan signal supplied to an i-th first scan line of the first scan lines;

a third transistor coupled between the second node and a third node coupled to a second electrode of the first transistor, and configured to be turned on by the second scan signal supplied to an i-th second scan line of the second scan lines;

a fourth transistor coupled between the second node and a first initialization power supply, and configured to be turned on by the second scan signal supplied to an i−1-th second scan line of the second scan lines;

a fifth transistor coupled between the first power supply and the first node, and configured to be turned off by the emission control signal supplied to an i-th emission control line of the emission control lines;

a sixth transistor coupled to the third node and the first electrode of the light emitting element, and configured to be turned off the emission control signal; and a storage capacitor coupled between the first power supply and the second node.

11. The display device according to claim 10, wherein the pixel disposed on the i-th horizontal line further comprises:

a seventh transistor coupled between the first electrode of the light emitting element and a second initialization power supply, and configured to be turned on by the first scan signal supplied to an i+1-th first scan line of the first scan lines, and wherein a voltage of the first initialization power supply is different than a voltage of the second initialization power supply.

12. The display device according to claim 10, wherein the pixel disposed on the i-th horizontal line further comprises:

a seventh transistor coupled between the first electrode of the light emitting element and the first initialization power supply, and configured to be turned on by the first scan signal supplied to an i+1-th first scan line of the first scan lines; and an eighth transistor coupled between the first node and the first initialization power supply, and configured to be turned on by the second scan signal supplied to the i−1-th second scan line.

13. The display device according to claim 10, wherein the pixel disposed on the i-th horizontal line further comprises:

a seventh transistor coupled between the first electrode of the light emitting element and the first initialization power supply, and configured to be turned on by the first scan signal supplied to an i+1-th first scan line of the first scan lines; and an eighth transistor coupled between the third node and the first initialization power supply, and configured to be turned on by the second scan signal supplied to the i−1-th second scan line.

14. The display device according to claim 10, wherein each of the first transistor, the second transistor, the fifth transistor, and the sixth transistor is a P-type transistor, and wherein each of the third transistor and the fourth transistor is an N-type oxide semiconductor transistor.

15. The display device according to claim 14, wherein the pixel disposed on the i-th horizontal line further comprises:

a seventh transistor coupled between the first electrode of the light emitting element and a second initialization power supply, and configured to be turned on by the second scan signal supplied to the i-th second scan line, wherein the seventh transistor is the N-type oxide semiconductor transistor, and wherein a voltage of the first initialization power supply is different than a voltage of the second initialization power supply.

16. The display device according to claim 14, wherein the pixel disposed on the i-th horizontal line further comprises:

a seventh transistor coupled between the first electrode of the light emitting element and the second initialization power supply, and configured to be turned on by the emission control signal supplied to the i-th emission control line, wherein the seventh transistor is the N-type oxide semiconductor transistor, and wherein a voltage of the first initialization power supply is different than a voltage of the second initialization power supply.

17. The display device according to claim 1, wherein a pixel disposed on an i-th (i is a natural number) horizontal line of the pixels comprises:

a light emitting element including a first electrode, and a second electrode coupled to a second power supply;

a first transistor including a first electrode coupled to a first node electrically connected to a first power supply, and configured to control a driving current based on a voltage of a second node;

a second transistor coupled between a first data line of the data lines and the first node, and configured to be turned on by the first scan signal supplied to an i-th first scan line of the first scan lines;

a third transistor coupled between the second node and a third node coupled to a second electrode of the first transistor, and configured to be turned on by the second scan signal supplied to an i-th second scan line of the second scan lines;

a fourth transistor coupled between the second node and a first initialization power supply, and configured to be turned on by a third scan signal supplied to an i-th third scan line; and a fifth transistor coupled between the first power supply and the first node, and configured to be turned off by the emission control signal supplied to an i-th emission control line of the emission control lines.

18. The display device according to claim 17, further comprising:

a third scan driver configured to supply a third scan signal to each of third scan lines coupled to the pixels at the second frequency, and wherein widths of the second and the third scan signals are greater than a width of the first scan signal.

19. The display device according to claim 18, wherein, when driven at the driving frequency, the second and the third scan drivers respectively supply the second and third scan signals during a first period of a frame period, and wherein, when driven at the driving frequency, the second and the third scan drivers do not supply the second and third scan signals during a second period of the frame period.

20. The display device according to claim 19, wherein, during the first period, the second scan signal supplied to the i-th second scan line does not overlap with the third scan signal supplied to the i-th third scan line.

21. The display device according to claim 19, wherein, during the first period, the third scan signal supplied to the i-th third scan signal overlaps with a first portion of the second scan signal supplied to the i-th second scan line, and the first scan signal supplied to the i-th first scan line overlaps with a second portion of the second scan signal supplied to the i-th second scan line.

22. A display device, comprising:

pixels coupled to first scan lines, second scan lines, emission control lines, and data lines;

a first scan driver configured to supply a first scan signal to each of the first scan is lines at a first frequency;

a second scan driver configured to supply a second scan signal to each of the second scan lines at a second frequency, wherein the first frequency is greater than the second frequency;

an emission driver configured to supply an emission control signal to each of the emission control lines at the first frequency;

a data driver configured to supply a data signal to each of the data lines at the second frequency; and a timing controller configured to control the second scan driver to supply the second scan signal during a first period of a frame period and not supply the second scan signal during a second period of the frame period.

* * * * *